US009952523B2

(12) United States Patent
Shimano et al.

(10) Patent No.: US 9,952,523 B2
(45) Date of Patent: Apr. 24, 2018

(54) TONER AND TONER PRODUCTION METHOD

(71) Applicant: CANON KABUSHIKI KAISHA, Tokyo (JP)

(72) Inventors: Tsutomu Shimano, Mishima (JP); Kunihiko Nakamura, Gotemba (JP); Kenta Kamikura, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/045,040

(22) Filed: Feb. 16, 2016

(65) Prior Publication Data

US 2016/0246195 A1 Aug. 25, 2016

(30) Foreign Application Priority Data

Feb. 25, 2015 (JP) ..... 2015-034758
Jan. 18, 2016 (JP) ..... 2016-007281

(51) Int. Cl.
*G03G 9/09* (2006.01)
*G03G 9/087* (2006.01)
*G03G 9/08* (2006.01)

(52) U.S. Cl.
CPC ..... *G03G 9/0926* (2013.01); *G03G 9/0804* (2013.01); *G03G 9/0806* (2013.01); *G03G 9/0821* (2013.01); *G03G 9/08708* (2013.01); *G03G 9/08711* (2013.01); *G03G 9/08755* (2013.01)

(58) Field of Classification Search
CPC .. G03G 9/091; G03G 9/0926; G03G 9/08711; G03G 9/08708; G03G 9/09378; G03G 9/09364; G03G 9/09328; G03G 9/08755; G03G 9/0806; G03G 9/0804
See application file for complete search history.

(56) References Cited

U.S. PATENT DOCUMENTS

| | | | | |
|---|---|---|---|---|
| 7,829,254 | B2 | 11/2010 | Kurose et al. | |
| 8,828,639 | B2 | 9/2014 | Kamikura et al. | |
| 8,916,319 | B2 | 12/2014 | Ikeda et al. | |
| 8,940,467 | B2 | 1/2015 | Hashimoto et al. | |
| 9,158,216 | B2 | 10/2015 | Shimano et al. | |
| 9,261,806 | B2 | 2/2016 | Moribe et al. | |
| 2013/0244165 | A1* | 9/2013 | Hashimoto | G03G 9/087 430/108.22 |
| 2015/0037727 | A1 | 2/2015 | Fukudome et al. | |
| 2015/0153666 | A1 | 6/2015 | Isono et al. | |
| 2015/0153667 | A1 | 6/2015 | Noji et al. | |
| 2015/0153668 | A1 | 6/2015 | Tanaka et al. | |
| 2015/0153669 | A1 | 6/2015 | Yoshida et al. | |
| 2015/0153670 | A1 | 6/2015 | Shimano et al. | |
| 2015/0248071 | A1 | 9/2015 | Katsura et al. | |
| 2015/0261110 | A1 | 9/2015 | Nakagawa et al. | |
| 2015/0277251 | A1 | 10/2015 | Tominaga et al. | |
| 2015/0286157 | A1 | 10/2015 | Masumoto et al. | |
| 2015/0370189 | A1 | 12/2015 | Tanaka et al. | |
| 2016/0070189 | A1 | 3/2016 | Mashida et al. | |
| 2017/0060015 | A1* | 3/2017 | Kubo | G03G 9/0926 |

FOREIGN PATENT DOCUMENTS

| | | | |
|---|---|---|---|
| JP | 3-113462 | A | 5/1991 |
| JP | 2006-30760 | A | 2/2006 |
| JP | 2007-279689 | A | 10/2007 |
| JP | 2010-72033 | A | 4/2010 |
| JP | 2013-182057 | A | 9/2013 |
| JP | 2013-210632 | A | 10/2013 |
| JP | 2013-257415 | A | 12/2013 |
| JP | 2014-231602 | A | 12/2014 |
| JP | 2017-049404 | A * | 3/2017 |

OTHER PUBLICATIONS

ESPACENET Bibliographic data of JP 2017-049404 A (pub. Mar. 2017).*
Japanese Patent Office J-PlatPat machine-assisted English-language translation of JP 2017-049404 A (pub. Mar. 2017).*

* cited by examiner

*Primary Examiner* — Janis L Dote
(74) *Attorney, Agent, or Firm* — Fitzpatrick Cella Harper and Scinto

(57) ABSTRACT

A toner including a toner particle containing a binder resin, a pigment, a pigment dispersant and an amorphous resin, in which the pigment dispersant has a rate of adsorption A1 (%) to the pigment of at least 80% and not more than 100%, the amorphous resin has a rate of adsorption A2 (%) to the pigment of at least 0% and not more than 60%, the binder resin has an Rf value (RfL) of at least 0.50 and not more than 1.00, and the amorphous resin has an Rf value (RfH) of at least 0.00 and not more than 0.35.

9 Claims, 3 Drawing Sheets

TONER AND TONER PRODUCTION METHOD

BACKGROUND OF THE INVENTION

Field of the Invention

This invention relates to a toner for use in developing an electrostatic latent image, created by an electrophotographic, electrostatic recording or toner jet recording technology, to form a toner image. The invention relates also to a method of producing such a toner.

Description of the Related Art

There exists lately a desire to lower the frequency of cartridge replacement and the frequency of toner replenishment (that is, to increase toner longevity) in printer and copiers, and also a desire to improve toner performance. Specifically, what is needed is a toner that can achieve the desired image density with a smaller amount of toner and that has an excellent durability—i.e., the ability to maintain a stable image quality over a long period of time.

An effective way for obtaining the desired image density with a small amount of toner is to finely disperse a pigment within the toner and thereby enhance the toner tinting strength. An effective way for obtaining a toner having excellent durability is to form a core-shell structure in which the toner surface is covered with a resin.

Japanese Patent Application Laid-open Nos. 2006-30760, H03-113462, 2013-182057 and 2013-210632 disclose suspension-polymerized toners to which pigment dispersants have been added.

Japanese Patent Application Laid-open No. 2013-257415 describes the formation of a core-shell structure by using a highly polar polyester resin in a suspension-polymerized toner.

SUMMARY OF THE INVENTION

In the toners described in the foregoing publications, the tinting strength of the toner is enhanced by adding a pigment dispersant. However, a core-shell structure is not formed in the toners mentioned in Japanese Patent Application Laid-open Nos. 2006-30760 and H03-113462, and so a toner having a good durability is difficult to obtain. As for the toners described in Japanese Patent Application Laid-open Nos. 2013-182057 and 2013-210632, owing to the low polarity of the resin that forms the shell, a distinct core-shell structure does not readily form, making a good durability difficult to achieve.

By contrast, while it is possible to achieve a good core-shell structure in the toner described in Japanese Patent Application Laid-open No. 2013-257415, the high-polarity polyester resin adsorbs to the pigment, resulting in a pigment dispersion state that falls short of what is desired. Hence, there remains room for improvement in the tinting strength of the toner. It is therefore an object of this invention to provide a long-lasting toner endowed with both a good tinting strength and a good durability. A further object of the invention is to provide a method of producing such a toner.

Accordingly, in a first aspect, the invention provides a toner which includes a toner particle containing a binder resin, a pigment, a pigment dispersant, and an amorphous resin. The pigment dispersant has a rate of adsorption A1(%) to the pigment of at least 80% and not more than 100%, as measured for a mixture obtained by mixing together 0.1 part by mass of the pigment dispersant, 1.0 part by mass of the pigment and 20 parts by mass of a solvent in which styrene and n-butyl acrylate are mixed in a 4:1 ratio by mass.

The amorphous resin has a rate of adsorption A2 (%) to the pigment of at least 0% and not more than 60%, as measured for a mixture obtained by mixing together 0.1 part by mass of the amorphous resin, 1.0 part by mass of the pigment and 20 parts by mass of a solvent in which styrene and n-butyl acrylate are mixed in a 4:1 ratio by mass.

The binder resin has an Rf value (RfL) of at least 0.50 and not more than 1.00, as measured by thin-layer chromatography at 60° C. using a solution of the binder resin, silica gel as a stationary phase and a developing solvent, the solution of the binder resin being obtained by mixing together 0.1 part by mass of the binder resin and 20 parts by mass of a solvent in which styrene and n-butyl acrylate are mixed in a 4:1 ratio by mass, and the developing solvent being obtained by mixing together styrene and n-butyl acrylate in a 1:1 ratio by mass.

The amorphous resin has an Rf value (RfH) of at least 0.00 and not more than 0.35, as measured by thin-layer chromatography at 60° C. using a solution of the amorphous resin, silica gel as a stationary phase and the developing solvent, the solution of the amorphous resin being obtained by mixing together 0.1 part by mass of the amorphous resin and 20 parts by mass of a solvent in which styrene and n-butyl acrylate are mixed in a 4:1 ratio by mass.

In a further aspect, the invention provides a method of producing the foregoing toner, the method comprising the step of producing the toner particle including step (1) or (2) below.

(1) A step including a granulating step of forming, in an aqueous medium, a particle of a polymerizable monomer composition containing a polymerizable monomer capable of forming the binder resin, the pigment, the pigment dispersant and the amorphous resin; and a polymerization step of polymerizing the polymerizable monomer included in the particle of the polymerizable monomer composition.

(2) A step including a dissolution step of dissolving or dispersing the binder resin, the pigment, the pigment dispersant and the amorphous resin in an organic solvent to prepare a resin solution; a granulating step of forming a particle of the resin solution in an aqueous medium; and a solvent removal step of removing the organic solvent included in the particle of the resin solution to produce a resin particle.

Further features of the invention will become apparent from the exemplary embodiments described below in conjunction with the attached drawings.

DESCRIPTION OF THE EMBODIMENTS

Figure 1:
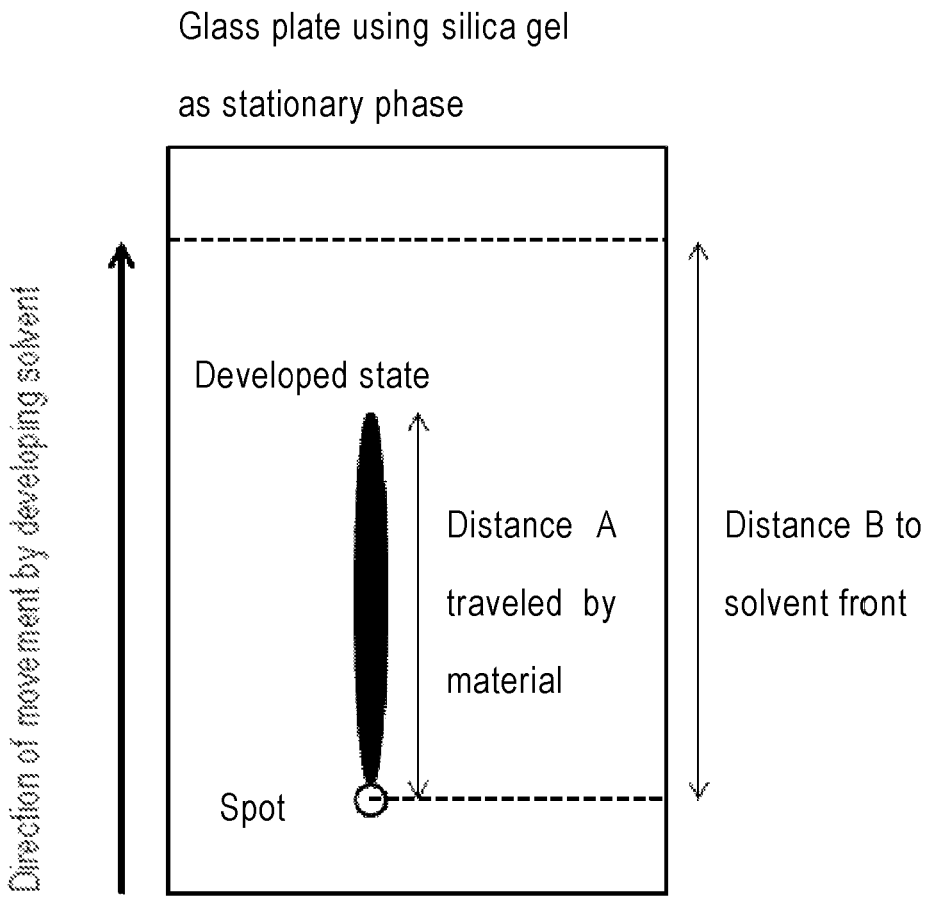
FIG. 1 is as schematic diagram showing a method for determining Rf values in the invention.

The toner of the invention includes a toner particle containing a binder resin, a pigment, a pigment dispersant, and an amorphous resin.

The pigment dispersant has a rate of adsorption A1 (%) to the pigment of at least 80% and not more than 100%, as measured for a mixture obtained by mixing together 0.1 part by mass of the pigment dispersant, 1.0 part by mass of the pigment and 20 parts by mass of a solvent in which styrene and n-butyl acrylate are mixed in a 4:1 ratio by mass.

The amorphous resin has a rate of adsorption A2 (%) to the pigment of at least 0% and not more than 60%, as measured for a mixture obtained by mixing together 0.1 part by mass of the amorphous resin, 1.0 part by mass of the pigment and 20 parts by mass of a solvent in which styrene and n-butyl acrylate are mixed in a 4:1 ratio by mass.

The binder resin has an Rf value (RfL) of at least 0.50 and not more than 1.00, as measured by thin-layer chromatography at 60° C. using a solution of the binder resin, silica gel as a stationary phase, and a developing solvent, the solution of the binder resin being obtained by mixing together 0.1 part by mass of the binder resin and 20 parts by mass of a solvent in which styrene and n-butyl acrylate are mixed in a 4:1 ratio by mass, and the developing solvent being obtained by mixing together styrene and n-butyl acrylate in a 1:1 ratio by mass.

The amorphous resin has an Rf value (RfH) of at least 0.00 and not more than 0.35, as measured by thin-layer chromatography at 60° C. using a solution of the amorphous resin, silica gel as a stationary phase and the developing solvent, the solution of the amorphous resin being obtained by mixing together 0.1 part by mass of the amorphous resin and 20 parts by mass of a solvent in which styrene and n-butyl acrylate are mixed in a 4:1 ratio by mass.

The inventors, in order to achieve an excellent tinting strength, initially focused on the rates of adsorption by the pigment dispersant and the amorphous resin to the pigment.

As shown in Japanese Patent Application Laid-open No. 2013-182057, in order for the dispersibility of a pigment in a toner to be improved by adding a pigment dispersant, it is necessary for the pigment dispersant to adsorb to the pigment; a higher adsorption rate results in a larger pigment dispersibility-enhancing effect.

When a pigment dispersant and an amorphous resin are added together, at the same time that the amorphous resin adsorbs to the pigment, the rate of adsorption of the pigment dispersant to the pigment decreases. This is presumably because, the pigment having a limited surface area, the materials (e.g., amorphous resin) are adsorbed while competing for pigment surface based on their rates of adsorption to the pigment.

In other words, when a pigment dispersant and an amorphous resin are used at the same time, to maximize the effect of the pigment dispersant, it is necessary to control not only the adsorption rate of the pigment dispersant to the pigment, but also the adsorption rate of the amorphous resin to the pigment.

The inventors have found, on further investigation of this phenomenon, that when the adsorption rate of amorphous resin to the pigment exceeds the value specified in this invention, the adsorption rate of pigment dispersant to the pigment abruptly drops, leading to a dramatic decline in pigment dispersibility.

In this invention, the rate of adsorption of the pigment dispersant to the pigment is referred to as "adsorption rate A1" (or simply "A1"), and the rate of adsorption of the amorphous resin to the pigment is referred to as "adsorption rate A2" (or simply "A2"). When A1 is at least 80% and not more than 100%, and A2 is at least 0% and not more than 60%, a toner having good pigment dispersibility can be obtained.

A adsorption rate A1 of at least 80% means that the adsorption rate of pigment dispersant to the pigment is sufficiently high and that there is a good pigment dispersing effect. Even when an amorphous resin is added, a decline in the adsorption rate of the pigment dispersant does not tend to occur, enabling the effects of the pigment dispersant to be maximized.

When A1 is below 80%, the adsorption rate of the pigment dispersant to the pigment is low. Moreover, the adsorption rate of the pigment dispersant to the pigment markedly decreases when an amorphous resin is added.

A adsorption rate A2 of not more than 60% means that the adsorption rate of the amorphous resin to the pigment is sufficiently low and that the adsorption rate of the pigment dispersant to the pigment does not tend to decline.

When A2 is higher than 60%, adsorption of the pigment dispersant to the pigment tends to be impeded and, even when A1 is at least 80%, a sufficient pigment-dispersing effect is not obtained.

A1 is preferably at least 90% and not more than 100%. A2 is preferably at least 0% and not more than 50%.

Yet, even assuming the tinting strength to be excellent, if the toner does not at the same time have an excellent durability, increased toner longevity is difficult to achieve. It is therefore the aim of this invention to add an amorphous resin and form a distinct core-shell structure so as to obtain a toner of excellent durability.

The inventors, in order to add an amorphous resin and form a distinct core-shell structure, turned their attention to the difference in polarity between the binder resin and the amorphous resin. They have found that the polarities of each material (binder resin, amorphous resin) can be expressed by carrying out thin-layer chromatography on these materials under the measurement conditions indicated in the invention. Moreover, they have found that a distinct core-shell structure can be formed by controlling these polarities.

In this invention, the polarities of the binder resin and the amorphous resin can be expressed as Rf values obtained by thin-layer chromatography.

The thin-layer chromatography carried out in this invention uses a mixed solvent of the low-polarity solvents styrene and n-butyl acrylate as the developing solvent, and also a glass plate having silica gel thereon as the stationary phase. Because silica gel is highly polar, materials that migrate more easily due to the developing solvent have a low polarity and materials that migrate less easily have a higher polarity. Here, letting the place where solutions of the respective materials are spotted onto the plate be the origin, the Rf value is expressed as A/B, where A is the distance that the material has traveled and B is the distance to the solvent front to which the developing solvent has ascended. This Rf value is a value particular to each material (FIG. 1). Hence, a material having a higher Rf value has a lower polarity, and a material having a lower Rf value has a higher polarity.

As a result of repeated investigations on the polarities of binder resins and amorphous resins, the inventors have discovered that the conditions for the formation of a distinct core-shell structure are a binder resin Rf value (also referred to below simply as "RfL") of at least 0.50 and not more than 1.00, and an amorphous resin Rf value (also referred to below simply as "RfH") of at least 0.00 and not more than 0.35. An RfL value of at least 0.50 means that the polarity of the binder resin is sufficiently low, and an RfH value of not more than 0.35 means that the polarity of the amorphous resin is sufficiently high.

By satisfying these conditions, a sufficient polarity difference arises between the binder resin and the amorphous resin. Particularly when producing toner particles in an aqueous medium, the amorphous resin selectively concentrates to the toner particle surface, making it possible to form a distinct core-shell structure.

When RfL is lower than 0.50 or RfH is higher than 0.35, the polarity difference between the binder resin and the amorphous resin is insufficient, and so a distinct core-shell structure cannot form. As a result, an excellent durability is not obtained.

RfL is preferably at least 0.80 and not more than 1.00, and RfH is preferably at least 0.00 and not more than 0.25.

Control of the RfL is preferably carried out by controlling the composition of the binder resin. For example, it is easy and convenient to carry out control by adjusting the amount of ester bonds introduced into the binder resin and adjusting the acid value of the binder resin.

Likewise, control of the RfH can be carried out by adjusting the amount of ester bonds introduced into the amorphous resin and adjusting the acid value of the amorphous resin. A method of control by introducing the subsequently described alicyclic structure is preferred from the standpoint of satisfying also the adsorption rate A2. The methods for measuring RfL and RfH are described later in the specification.

The inventors have additionally found that the adsorption rate A2 also has a large influence on the core-shell structure of toner particles. When the adsorption A2 is high, amorphous resin adsorbs to the pigment, greatly decreasing the amount of amorphous resin that concentrates at the surface layer of the toner particles. Moreover, the amorphous resin concentrates at the surface of the toner particles while remaining adsorbed to the pigment. As a result, charging performance of toner may lower, and thereby toner durability suffers. That is, an excellent durability is obtained only when the adsorption rate A2 and RfH conditions are both satisfied at the same time. When only one of these physical properties is satisfied, the durability effect shown by this invention is not achieved, making it impossible to provide increased toner longevity.

Hence, to obtain a toner having both excellent durability and excellent tinting strength, and thereby provide increased toner longevity, the design of the amorphous resin in particular is important. It is critical for the adsorption rate A2 to be designed to not more than 60% and the RfH to be designed to not more than 0.35.

However, the adsorbability of resins and pigments is thought to be generally governed by van der Waals forces, hydrogen bond strengths and acid-base interaction forces (see Chapter 5, Section 1 of Chōbiryūshi no bunsan gijutsu to sono hyōka [Ultrafine particle dispersion technology and evaluation] from Science & Technology Sha Shuppan). Therefore, when the polarity of the amorphous resin is simply increased, there is a tendency for the hydrogen bond strength and acid-base interaction forces to rise and the adsorption rate A2 to become larger. This invention, by clarifying the material properties which make it possible to achieve the above-mentioned durability and tinting strength and by newly designing an amorphous resin in accordance with these conditions, makes it possible to achieve both a good durability and a good tinting strength.

The adsorption rate A1 can be achieved by designing the structure of the pigment-adsorbing segment of the pigment dispersant so to match the properties of the pigment. One exemplary approach is to introduce a chemical structure having π electrons into the pigment-adsorbing segment of the pigment dispersant, and thereby increase the van der Waals forces. Another possible approach is to introduce a polar group or a binding segment having a high polarity, and thereby increase the hydrogen bond strength with the pigment or the acid-base interaction forces. Yet another suitable approach is to introduce a pigment analog structure at the pigment-adsorbing segment of the pigment dispersant.

That is, the adsorption rate A1 can be controlled by introducing, for example, a benzene ring structure, a carboxy group or an amide bond to the structure of the pigment-adsorbing segment on the pigment dispersant, or by adjusting the amount of pigment-adsorbing segment.

Control of adsorption rate A2 can be achieved by controlling the composition of the amorphous resin. One exemplary approach is to lower the amount of benzene rings introduced onto the amorphous resin and thereby reduce the number of π electron-containing structures. Another preferred approach is to reduce the number of polar groups on the amorphous resin and thereby lower the hydrogen bond strength with the pigment or the acid-base interaction forces. More specifically, control can be achieved by adjusting the content ratio of the subsequently described monomer units having an alicyclic structure, the amount of ester bonds or the amount of carboxy groups.

Methods for measuring adsorption rate A1 and adsorption rate A2 are described later in the specification.

In this invention, a known amorphous resin may be used without limitation as the amorphous resin, provided it is one that satisfies the above conditions. Exemplary amorphous resins include polyester resins, styrene-acrylic resins, polyamide resins, furan resins, epoxy resins, xylene resins and silicone resins. Of these, polyester resins are preferred, in order to satisfy both the adsorption rate A2 and the RfH value at the same time. By having the amorphous resin be a polyester resin, a low RfH value is easily achieved while keeping the adsorption rate A2 low. This is because, without increasing acidic groups, basic groups and structures having π electrons, adjustment to a high polarity is achieved through the amount of ester bonds, the amount of carboxy groups and the content ratio of the subsequently described monomer units having an alicyclic structure. As a result, an excellent durability can be obtained while maintaining a good tinting strength.

These polyester resins may be prepared by, for example, dehydrative condensation of the following dibasic acids or derivatives thereof (acid halides, esters, acid anhydrides) and dihydric alcohols as the essential components and, optionally, trifunctional and higher polybasic acids and derivatives thereof (acid halides, esters, acid anhydrides), monobasic acids, trihydric and higher alcohols and monohydric alcohols.

Illustrative examples of dibasic acids includes aliphatic dibasic acids such as maleic acid, fumaric acid, itaconic acid, oxalic acid, malonic acid, succinic acid, dodecylsuccinic acid, dodecenylsuccinic acid, adipic acid, azelaic acid, sebacic acid and decane-1,10-dicarboxylic acid; aromatic dibasic acids such as phthalic acid, tetrahydrophthalic acid, hexahydrophthalic acid, tetrabromophthalic acid, tetrachlorophthalic acid, HET acid, himic acid, isophthalic acid, terephthalic acid and 2,6-naphthalenedicarboxylic acid; and the subsequently described alicyclic dibasic acids.

Exemplary dibasic acid derivatives include acid halides, esters and acid anhydrides of the above aliphatic dibasic acids, aromatic dibasic acids and alicyclic dibasic acids.

Illustrative examples of the dihydric alcohols include non-cyclic aliphatic diols such as ethylene glycol, 1,2-propylene glycol, 1,4-butanediol, 1,5-pentanediol, 1,6-hexanediol, diethylene glycol, dipropylene glycol, triethylene glycol and neopentyl glycol; bisphenols such as bisphenol A and bisphenol F; alkylene oxide adducts of bisphenol A, such as ethylene oxide adducts of bisphenol A and propylene oxide adducts of bisphenol A; aralkylene glycols such as xylylene diglycol; and the subsequently described alicyclic diols.

Illustrative examples of polybasic acids having a functionality of three or more and anhydrides thereof include trimellitic acid, trimellitic anhydride, 1,3,5-cyclohexanetricarboxylic acid, 1,2,4-cyclohexanetricarboxylic acid, 1,2,4,5-cyclohexanetetracarboxylic acid, 1,2,3,4,5,6-cyclohexanehexacarboxylic acid, methylcyclohexenetricarboxylic acid, methylcyclohexenetricarboxylic anhydride, pyromellitic acid and pyromellitic anhydride.

The polyester resin may be one that is partially modified with another resin, the polyester resin may be either a block polymer or a graft polymer.

In this invention, it is more preferable for the polyester resin to have, on at least one of a main chain and a side chain, units derived from an alcohol (diol) having an alicyclic structure or units derived from a carboxylic acid having an alicyclic structure.

The content ratio of units derived from the alcohol having an alicyclic structure or units derived from the carboxylic acid having an alicyclic structure, based on all the monomer units of the polyester resin, is more preferably at least 0.1 mol % and not more than 50 mol %.

By having the polyester resin include units derived from an alcohol having an alicyclic structure or units derived from a carboxylic acid having an alicyclic structure, it is possible to increase the polarity without increasing the number of structures having $\pi$ electrons. As a result, the RfH can be lowered while suppressing a rise in the adsorption rate A2.

At a content ratio of units derived from an alcohol having an alicyclic structure or units derived from a carboxylic acid having an alicyclic structure of at least 0.1 mol %, the polyester resin can be designed so as to have a sufficiently high polarity, enabling an even better durability to be obtained.

At a content ratio of such units up to 50 mol %, it is possible to keep the adsorption rate A2 low and to obtain an excellent tinting strength. The content ratio of such units is more preferably at least 2.0 mol % and not more than 30 mol %.

Moreover, it is preferable for the polyester resin to have, as the units derived from the alcohol, units derived from a non-cyclic aliphatic diol. The content ratio of the units derived from the non-cyclic aliphatic diol, based on all the monomer units of the polyester resin, is preferably at least 10 mol % and not more than 30 mol %, and more preferably at least 10 mol % and not more than 20 mol %. The non-cyclic aliphatic diol is preferably ethylene glycol.

As used herein, "alicyclic compound" refers to a compound which includes a cyclic structure and lacks aromaticity. This may be an alicyclic hydrocarbon in which the cyclic structure consists solely of carbon and hydrogen as the constituent elements, or may be an alicyclic heterocyclic compound which also includes an element other than carbon and hydrogen in the cyclic structure. Of these, an alicyclic hydrocarbon in which the cyclic structure consists solely of carbon and hydrogen is more preferred. When an alicyclic hydrocarbon is used, an excellent charging performance can be maintained even in a high-humidity environment, thus enabling an excellent image quality to be maintained over a longer period of time.

Illustrative examples of alcohols having an alicyclic structure and carboxylic acids having an alicyclic structure that can be used include the following: alicyclic dibasic and polybasic acids such as 1,4-cyclohexanedicarboxylic acid, 1,3-cyclohexanedicarboxylic acid, 1,2-cyclohexanedicarboxylic acid, 4-methyl-1,2-cyclohexanedicarboxylic acid, cis-4-cyclohexene-1,2-dicarboxylic acid, cis-1-cyclohexene-1,2-dicarboxylic acid, norbornanedicarboxylic acid, norbornenedicarboxylic acid, 1,3-adamantanedicarboxylic acid, 1,3,5-cyclohexanetricarboxylic acid, 1,2,4-cyclohexanetricarboxylic acid, 1,2,4,5-cyclohexanetetracarboxylic acid, 1,2,3,4,5,6-cyclohexanehexacarboxylic acid and methylcyclohexenetricarboxylic acid; and alicyclic diols such as 1,4-cyclohexanediomethanol, hydrogenated bisphenol A, 1,4-cyclohexanediol, 1,2-cyclohexanediol, 1,3-cyclohexanediol, 4-(2-hydroxyethyl)cyclohexanol, 4-(hydroxymethyl)cyclohexanol, 4,4'-bicyclohexanol and 1,3-adamantanediol.

Illustrative examples of monomers having an alicyclic heterocyclic structure include alcohol monomers such as isosorbide and spiroglycol.

The method of analyzing the composition of the amorphous resin and the method of measuring the content ratio of these units are described later in the specification. Also, for the purposes of this invention, "side chain" is defined below (source: Kōbunshi Gakkai Yōgoshū [Glossary of The Society of Polymer Science, Japan]) as "branches, side chains, and pendant molecular chains," and as not including "pendant groups and side groups". The language in Kōbunshi Gakkai Yōgoshū is as follows:

"1.53 Branch, Side Chain, Pendant Molecular Chain

An oligomeric or high-molecular-weight branch which extends from the molecular chain of a polymer."1.56 Pendant Group, Side Group A side branch which emerges from a main chain, and which is neither an oligomer molecular chain nor a polymer molecular chain."

In other words, the side chains in this invention have recurring units which are similar to the main chain.

The amorphous resin has a weight-average molecular weight (Mw) of preferably at least 5,000 and not more than 50,000. Within this range, the amorphous resin, when concentrated primarily at the toner particle surface, enables an excellent durability to be achieved. This Mw is more preferably at least 11,000 and not more than 40,000. The Mw of the amorphous resin can be controlled by conditions such as the polymerization temperature and time during production of the amorphous resin. The method of measuring the Mw of the amorphous resin is described later in the specification.

The acid value of the amorphous resin is preferably at least 1.0 mgKOH/g and not more than 30.0 mgKOH/g. Within this range, the charging characteristics of the toner are not readily affected by the surrounding environment, enabling an excellent durability to be maintained over an extended period of time.

The method of controlling the acid value of the amorphous resin differs according to the type of resin of which it is made. When the amorphous resin is a polyester resin, the acid value can be controlled by adjusting the contents and molecular weights of the acid monomers and the alcohol monomers, the amounts of monofunctional acid monomer and/or alcohol monomer, and the amounts of trifunctional acid monomer and/or alcohol monomer during production of the amorphous resin. When the amorphous resin is a styrene-acrylic resin, the acid value can be controlled by adjusting the amounts of carboxy group-containing polymerizable monomers such as acrylic acid and methacrylic acid. The method for measuring the acid value of the amorphous resin is described later in the specification.

The content of this amorphous resin per 100 parts by mass of the binder resin is preferably at least 1.0 part by mass and not more than 10.0 parts by mass, and more preferably at least 2.0 parts by mass and not more than 7.0 parts by mass.

In the practice of the invention, known pigment dispersants may be used without limitation as the pigment dispersant, provided they are ones that satisfy the adsorption rate A1. It is preferable for the pigment dispersant used in the invention to include a pigment-adsorbing segment that adsorbs to pigment and a styrene-acrylic resin segment. Alternatively, it is preferable for the pigment dispersant to have a structure in which a pigment-adsorbing segment and a styrene-acrylic resin segment are bonded through a linking group. In a pigment dispersant of this structure, the pigment-adsorbing segment adsorbs to the pigment surface and the styrene-acrylic resin segment, which is a dispersion component for the resin, spreads out and is present around the pigment, thus maintaining dispersion of the pigment. Because this styrene-acrylic resin segment can be designed to have a low polarity, it does not readily adsorb to the pigment surface and thoroughly spreads out around the pigment, enabling dispersion of the pigment to be well maintained. The method for analyzing the composition of this pigment dispersant is described later in the specification.

Compounds capable of use as the pigment-dispersing segment of the pigment dispersant may be selected based on the van der Waals forces, hydrogen bond strength and acid-base interaction forces mentioned above. Illustrative examples include compounds having sulfonic acid groups, carboxy groups, phosphoric acid groups, hydroxy groups, amino groups, quaternary ammonium groups, quaternary pyridinium groups, quaternary imidazole groups, amine groups, imine groups, nitrile groups, nitro groups, nitroso groups, ester bonds, amide bonds or urethane bonds, and pigment analogs.

Preferred examples are used in the following description, although the invention is not limited to these. Examples of the pigment dispersant include compounds having a pigment-dispersing segment of formula (1) below and having a styrene-acrylic resin segment. This pigment dispersant has a structure in which the pigment-dispersing segment of formula (1) and the styrene-acrylic resin segment are bonded through a divalent linking group.

Formula (1)

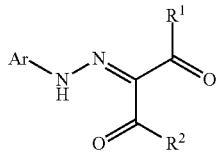

In formula (1), $R^1$ and $R^2$ are each independently a substituted or unsubstituted alkyl group, a substituted or unsubstituted phenyl group, —$OR^5$ or —$NR^6R^7$, $R^5$, $R^6$ and $R^7$ are each independently a hydrogen atom, a substituted or unsubstituted alkyl group, a substituted or unsubstituted phenyl group or an aralkyl group;

Ar is a substituted or unsubstituted aryl group; and at least one of $R^1$, $R^2$ and Ar is a substituent having a linking group that bonds with the styrene-acrylic resin segment, the substituent having the same meaning as groups represented by $R^1$, $R^2$ and Ar.

When at least one of $R^1$ and Ar is a substituent having a linking group that bonds with the styrene-acrylic resin segment, the linking group is a divalent linking group selected from the group consisting of amide groups [—C(═O)—NH—], ester groups [—C(═O)—O—], urethane groups [—NH—C(═O)—O—], urea groups [—NH—C(═O)—NH—], alkylene groups, phenylene groups, —O—, —$NR^8$— and —NHCH ($CH_2OH$)—, $R^8$ is a hydrogen atom, an alkyl group, a phenyl group or an aralkyl group.

When $R^2$ is a substituent having a linking group that bonds with the styrene-acrylic resin segment, the linking group is a divalent linking group selected from the group consisting of amide groups [—C(═O)—NH—], ester groups [—C(═O)—O—], urethane groups [—NH—C(═O)—O—], urea groups [—NH—C(═O)—NH—], alkylene groups, phenylene groups, —O—, —$NR^9$— and —NHCH($CH_2OH$)—, $R^9$ is a hydrogen atom, an alkyl group, a phenyl group or an aralkyl group.

In this invention, illustrative examples of alkyl groups that may serve as $R^1$ and $R^2$ in formula (1) include alkyl groups having a linear structure, branched structure or cyclic structure, such as methyl, ethyl, n-propyl, n-butyl, n-pentyl, n-hexyl, isopropyl, isobutyl, sec-butyl, tert-butyl and cyclohexyl groups.

Illustrative examples of aralkyl groups that may serve as $R^1$ and $R^2$ in formula (1) include benzyl and phenethyl groups.

Illustrative examples of the substituents on the substituted alkyl groups and substituted phenyl groups that may serve as $R^1$, $R^2$, $R^5$, $R^6$ and $R^7$ in formula (1) include alkyl groups of 1 to 6 carbon atoms, alkoxy groups of 1 to 6 carbon atoms, halogen atoms, nitro groups, amino groups, carbamoyl groups, ureido groups, hydroxy groups, cyano groups and trifluoromethyl groups.

In the invention, Ar represents a substituted or unsubstituted aryl group, examples of which include phenyl and naphthyl groups. The substituents are exemplified by alkyl groups of 1 to 6 carbon atoms, alkoxy groups of 1 to 6 carbon atoms, halogen atoms, hydroxy groups, carbamoyl groups, ureido groups, amino groups, carboxy groups, alkoxycarbonyl groups and carboxyamide groups.

From the standpoint of affinity to the pigment, $R^1$ is preferably an alkyl group of 1 to 6 carbon atoms, a phenyl group, a —$OCH_3$ group or a —$OCH_2C_6H_5$ group. $R^2$ is preferably a —$NR^6R^7$ group, with $R^6$ being preferably a hydrogen atom and $R^7$ being preferably a phenyl group.

The combination of substituents in formula (1) is illustrated below by way of the following, non-limiting, examples. Specific examples include those having formulas (2) to (5) below.

Formula (2)

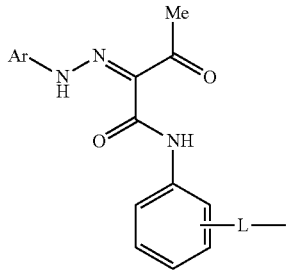

In formula (2), Ar is as defined in formula (1), Me represents a methyl group, and L is a divalent linking group for bonding with a styrene-acrylic resin segment.

Formula (3)

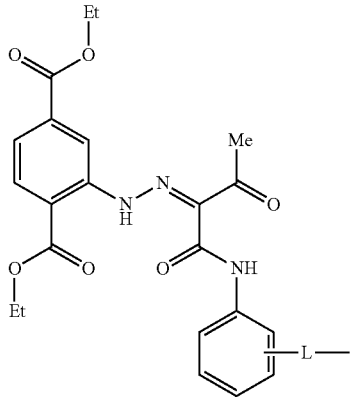

In formula (3), Me represents a methyl group, Et represents an ethyl group, and L is a divalent linking group for bonding with a styrene-acrylic resin segment.

Formula (4)

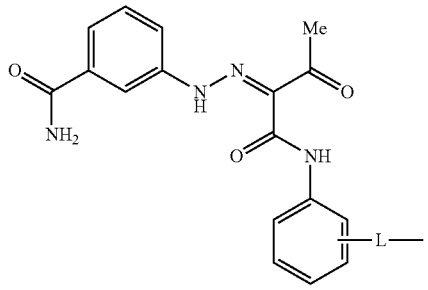

In formula (4), Me represents a methyl group, and L is a divalent linking group for bonding with a styrene-acrylic resin segment.

Formula (5)

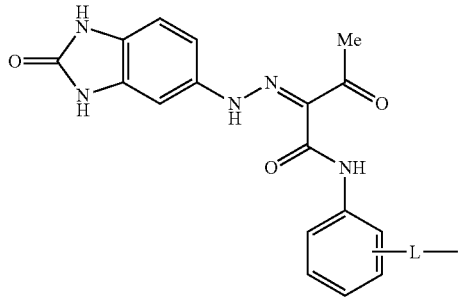

In formula (5), Me represents a methyl group, and L is a divalent linking group for bonding with a styrene-acrylic resin segment.

The styrene-acrylic resin segment included in the pigment dispersant is exemplified by copolymers of styrene monomers with acrylic monomers and/or methacrylic monomers.

Illustrative examples of styrene monomers include styrene; styrene derivative such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene and p-phenylstyrene.

Illustrative examples of acrylic monomers include methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, stearyl acrylate, behenyl acrylate, cyclohexyl acrylate, benzyl acrylate, dimethyl phosphate ethyl acrylate, diethyl phosphate ethyl acrylate, dibutyl phosphate ethyl acrylate and 2-benzoyloxyethyl acrylate.

Illustrative examples of methacrylic monomers include methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, stearyl methacrylate, behenyl methacrylate, diethyl phosphate ethyl methacrylate and dibutyl phosphate ethyl methacrylate.

In this invention, the content of pigment dispersant per 100 parts by mass of binder resin is preferably at least 0.1 part by mass and not more than 3.0 parts by mass, and more preferably at least 0.4 part by mass and not more than 1.5 parts by mass.

The amount of pigment dispersant used per 100 parts by mass of pigment is preferably at least 2.0 parts by mass and not more than 20.0 parts by mass, and more preferably at least 4.0 parts by mass and not more than 15.0 parts by mass.

In the practice of the invention, known resins that are used in conventional toners may be used as the binder resin. Of these, from the standpoint of forming a core-shell structure in toner particles, a styrene-acrylic resin for which the RfL can be designed to a large value is preferred.

The polymerizable monomers making up the styrene-acrylic resin are exemplified in the same way as for the styrene-acrylic resin used in the pigment dispersant. In addition, a polyfunctional monomer may be added. Illustrative examples of the polyfunctional monomer include diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis(4-(acryloxydiethoxy)phenyl)propane, trimethylolpropane triacrylate, tetramethylolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis(4-methacryloxydiethoxy)phenyl)propane, 2,2'-bis(4-(methacryloxypolyethoxy)phenyl)propane, trimethylolpropane trimethacrylate, tetramethylolmethane tetramethacrylate, divinylbenzene, divinylnaphthalene and divinyl ether.

Hitherto known pigments may be used as the pigment in this invention. An example of a suitable black pigment is carbon black.

Exemplary yellow pigments include monoazo compounds, disazo compounds, condensed azo compounds, isoindolinone compounds, isoindoline compounds, benzimidazolone compounds, anthraquinone compounds, azo metal complexes, methine compounds and allylamide compounds. Illustrative examples include C.I. Pigment Yellow 74, 93, 95, 109, 111, 128, 155, 174, 180 and 185.

Exemplary magenta pigments include monoazo compounds, condensed azo compounds, diketopyrrolopyrrole compounds, anthraquinone compounds, quinacridone compounds, basic dye lake compounds, naphthol compounds, benzimidazolone compounds, thioindigo compounds and perylene compounds. Illustrative examples include C.I. Pigment Red 2, 3, 5, 6, 7, 23, 48:2, 48:3, 48:4, 57:1, 81:1, 122, 144, 146, 150, 166, 169, 177, 184, 185, 202, 206, 220, 221, 238, 254 and 269, and C.I. Pigment Violet 19.

Exemplary cyan pigments include copper phthalocyanine compounds and derivatives thereof, anthraquinone compounds, and basic dye lake compounds. Illustrative examples include C.I. Pigment Blue 1, 7, 15, 15:1, 15:2, 15:3, 15:4, 60, 62 and 66. Of these, using a pigment having an aromatic ring on the structure is preferable because, from the standpoint of the van der Waals forces, the adsorption rate is easy to control. Together with the above pigment, various types of hitherto known dyes may also be used as colorants.

The pigment content per 100 parts by mass of the binder resin is preferably at least 1.0 part by mass and not more than 20.0 parts by mass.

In the toner of the invention, it is advantageous for an external additive to be externally added to the toner particles in order to enhance image quality. External additives that may be suitably used include inorganic fine powders such as silica fine powder, titanium oxide fine powder and aluminum oxide fine powder. These inorganic fine powders are preferably subjected to hydrophobic treatment with a hydrophobic agent such as a silane coupling agent, a silicone oil or a mixture thereof. External additives other than the above may also be optionally mixed into the toner particles of the inventive toner. The total amount of inorganic fine powder added per 100 parts by mass of toner particles (the toner particles prior to the addition of external additive) is at least 1.0 part by mass and not more than 5.0 parts by mass.

In the practice of the invention, the toner may be produced by a known production method such as a pulverization method, a suspension polymerization method, an emulsion aggregation method or a dissolution suspension method. The production method is not limited to these.

In this invention, a method of producing the toner preferably includes the step of producing the toner particle including step (1) or (2) below:

(1) a step including a granulating step of forming, in an aqueous medium, a particle of a polymerizable monomer composition containing a polymerizable monomer capable of forming a binder resin, a pigment, a pigment dispersant and an amorphous resin; and a polymerization step of polymerizing the polymerizable monomer included in the particle of the polymerizable monomer composition, (2) a step including a dissolution step of dissolving or dispersing a binder resin, a pigment, a pigment dispersant and an amorphous resin in an organic solvent to prepare a resin solution; a granulating step of forming a particle of the resin solution in an aqueous medium; and a solvent removal step of removing the organic solvent included in the particle of the resin solution to produce a resin particle.

To efficiently produce toner particles having a core-shell structure, a method which produces the toner particles in an aqueous medium is preferred.

That is, it is preferable for a toner particle to be:

(1) a toner particle obtained via a granulating step of forming, in an aqueous medium, a particle of a polymerizable monomer composition containing a polymerizable monomer that forms binder resin, a pigment, a pigment dispersant and an amorphous resin; and a polymerization step of polymerizing the polymerizable monomer included in the particle of the polymerizable monomer composition; or (2) a toner particle obtained via a dissolution step of dissolving or dispersing a binder resin, a pigment, a pigment dispersant and an amorphous resin in an organic solvent to prepare a resin solution; a granulating step of forming a particle of the resin solution in an aqueous medium; and a solvent removal step of removing the organic solvent included in the particle of the resin solution to produce a resin particle.

Because the toner particles have been obtained via the above steps, the highly polar amorphous resin is primarily concentrated at the oil-water interfaces that form in the granulating step. As a result, a more distinct core-shell structure can form, enabling an excellent durability to be obtained.

A production method using the above suspension polymerization method (1) is illustrated more fully below, but is not limited thereto.

A polymerizable monomer composition is prepared by mixing together a polymerizable monomer, a pigment, a pigment dispersant and an amorphous resin, and using a dispersing apparatus such as a homogenizer, ball mill, colloid mill or ultrasonic disperser to dissolve or disperse these ingredients. Where necessary, known release agents and charge control agents, solvents for adjusting the viscosity, crystalline resins, plasticizers, chain transfer agents and other additives may be suitably added to the polymerizable monomer composition at this time.

Next, granulation is carried out by charging the polymerizable monomer composition into a dispersion stabilizer-containing aqueous medium that has been prepared beforehand and using a high-speed disperser such as a high-speed agitator or an ultrasonic disperser to effect suspension.

A polymerization initiator may be used when polymerizing the polymerizable monomers included in the polymerizable monomer composition particles. The polymerization initiator may be mixed together with other additives during preparation of the polymerizable monomer composition or may be mixed into the polymerizable monomer composition just prior to suspension in an aqueous medium. Alternatively, if necessary, the initiator may be dissolved in polymerizable monomer or another solvent and added either during granulation or following the completion of granulation; that is, just prior to the start of the polymerization reaction.

The granulated suspension is heated and the polymerization reaction is carried out and brought to completion under stirring in such a way as to maintain the polymerizable monomer composition particles within the suspension in a particulate state and keep the particles from floating or settling, and solvent removal treatment is carried out if necessary, thereby forming an aqueous dispersion of the toner particles.

Next, if necessary, water rinsing is carried out, following by drying and classification by any of various methods, thereby yielding the toner particles. In addition, the above-mentioned inorganic fine powder and the like may be externally added to the toner particles, thereby giving the toner.

The toner of the invention may be used as a one-component developer, or may be mixed together with a magnetic carrier and used as a two-component developer.

Methods for measuring the various physical properties specified in the invention are described below.

<Method of Measuring Adsorption Rate A1 of Pigment Dispersant to Pigment, and Adsorption Rate A2 of Amorphous Resin to Pigment>

Adsorption rates A1 and A2 are measured as follows.

(1) The following materials and glass beads are weighed out into a 50 mL pressure bottle.

Pigment: 1.0 g

Pigment dispersant or amorphous resin: 0.1 g

Styrene (solvent): 16.0 g n-Butyl acrylate (solvent): 4.0 g

Glass beads (diameter, 0.8 mm): 30.0 g (2) The above materials are mixed together and then shaken for 10 hours with a paint shaker (Toyo Seiki Co., Ltd.), thereby dispersing the pigment in the solvents.

(3) The shaken dispersion is then separated using a centrifugal separator (Eppendorf Minispin Plus; 14,500 rpm; 30 min), and the supernatant is collected.

(4) The supernatant is filtered with MILLEX filter LH 0.45 μm (Nihon Millipore), and the filtrate (i.e., the mixture of the above materials, excluding the glass beads) is analyzed by gel permeation chromatography (GPC). The conditions of GPC analysis are generally in accordance with the subsequently described method for measuring the weight-average molecular weights (Mw) of the pigment dispersant and amorphous resin. That is, the filtrate obtained is dissolved in tetrahydrofuran (THF) and then filtered with a solvent-resistant membrane filter, giving a sample solution, following which the sample solution is measured under the subsequently described conditions. The peak area of the resulting chromatogram (vertical axis: concentration-dependent electrical strength; horizontal axis: retention time) is treated as S1. The vertical axis is not particularly limited, provided it is a concentration-dependent indicator.

(5) A solution obtained by mixing together the materials shown below is similarly filtered with MILLEX filter LH 0.45 μm (Nihon Millipore), and the filtrate is analyzed by GPC. The peak area of the resulting chromatogram is treated as S2. In order to calculate the area ratio between S1 and S2, the chromatograms for determining the peak areas S1 and S2 are created using vertical and horizontal axes drawn to the same scale.

Pigment dispersant or resin: 0.1 g

Styrene: 16.0 g n-Butyl acrylate: 4.0 g (6) The adsorption rate of the pigment dispersant or amorphous resin to the pigment is calculated from the following formula.

$$\text{Adsorption rate (\%)}=(1-S1/S2)\times 100$$

<Method of Measuring Rf Value of Binder Resin (RfL) and Rf Value of Amorphous Resin (RfH)>

The Rf value of the binder resin (RfL) and the Rf value of the amorphous resin (RfH) are measured as follows.

(1) The following materials are weighed into a 50 mL pressure bottle, and a binder resin or amorphous resin solution is prepared.

Binder resin or amorphous resin: 0.1 g

Styrene: 16.0 g n-Butyl acrylate: 4.0 g (2) A glass plate having silica gel thereon as the stationary phase (TLC LuxPlate silica gel 60 F254, 5 cm (width)×10 cm (direction of travel), from Merck Millipore) is used as the thin-layer chromatography plate.

The above solution is sampled with a 0.5 mm diameter capillary, and a 3 mm diameter spot is placed at a position 1.5 cm from the bottom of the glass plate.

(3) A liquid obtained by mixing together styrene and n-butyl acrylate in a 1:1 ratio by mass is measured out as the developing solvent to a height of 1 cm in a jar sized to accommodate the glass plate, and is warmed to 60° C.

(4) Development is carried out by immersing the bottom 1 cm of the glass plate in the developing solvent.

(5) Development is continued while holding the temperature at 60° C. until the developing solvent reaches a position 1 cm from the top end of the glass plate; once development is complete, the plate is removed. The distance that the developing solvent has ascended is measured, and this value is designated as B.

(6) The glass plate is thoroughly dried.

(7) Ultraviolet light having a wavelength of 254 nm is applied to the glass plate using a UV light (SLUV-6 Handy UV Lamp, As One Corporation), and the distance A traveled by each material is measured.

(8) The Rf value is calculated as A/B.

<Method of Analyzing Pigment Dispersant and Amorphous Resin Compositions>

Analyses of the pigment dispersant and amorphous resin compositions are carried out from NMR spectrum measurements of each material. NMR spectrum measurements of the pigment dispersant and the amorphous resin are carried out using $^{1}$H-NMR spectroscopy (400 MHz, CDC13, room temperature (25° C.)). Measurement apparatus: FT NMR system (JNM-EX400, from JEOL, Ltd.)

Measurement frequency: 400 MHz

Pulse conditions: 5.0 μs

Frequency range: 10,500 Hz

Number of runs: 64

Compositional analysis is carried out based on the NMR spectrum measured by the above method.

<Method of Measuring Weight-Average Molecular Weights (Mw) of Pigment Dispersant, Amorphous Resin and Toner>

The weight-average molecular weights (Mw) of the pigment dispersant, amorphous resin and toner are measured as follows by gel permeation chromatography (GPC). The weight-average molecular weight of the toner is the weight-average molecular weight obtained by measuring the THF soluble matter of the toner.

First, the pigment dispersant, amorphous resin or toner is dissolved in tetrahydrofuran (THF) at room temperature over a period of 24 hours. Next, the resulting solution is filtered with a solvent-resistant membrane filter having a pore diameter of 0.2 μm (MyShoriDisk, from Tosoh Corporation), thereby giving a sample solution. The sample solution is adjusted so that the concentration of THF-soluble matter becomes 0.8 mass %. Using this sample solution, measurement is carried out under the following conditions.

Apparatus: HLC 8120 GPC (detector: RI), from Tosoh Corporation

Columns: A series of seven columns—Shodex KF-801, 802, 803, 804, 805, 806, 807 (Showa Denko K.K.)

Eluant: tetrahydrofuran (THF)

Flow rate: 1.0 mL/min

Oven temperature: 40.0° C.

Amount of sample injected: 0.10 mL

A molecular weight calibration curve prepared using standard polystyrene resins (available from Tosoh Corporation under the trade names TSK Standard Polystyrene F-850, F-450, F-288, F-128, F-80, F-40, F-20, F-10, F-4, F-2, F-1, A-5000, A-2500, A-1000 and A-500) is used to calculate the molecular weight of the sample.

<Method of Measuring Acid Value of Amorphous Resin>

The acid value of the amorphous resin is measured in accordance with JIS K1557-1970. The method of measurement is as follows.

First, 2 g of pulverized sample is weighed precisely (W (g)). The sample is placed in a 200 mL Erlenmeyer flask, 100 mL of a toluene/ethanol (2:1) mixed solution is added, and the sample is dissolved for 5 hours. If necessary, heat may be applied at this time. Phenolphthalein solution is added as an indicator.

The above solution is titrated with a 0.1 mol/L KOH alcohol solution using a burette. The amount of KOH alcohol solution used for titration at this time is designated as S (mL). A blank test is also carried out and the amount of KOH alcohol solution used at this time is designated as B (mL).

The acid value is calculated using the following formula. In the formula, "f" is the KOH solution factor.

$$\text{Acid value(mg KOH/g)}=[(S-B)\times f\times 5.61]/W$$

<Method of Measuring Glass Transition Temperatures Tg (° C.) of Amorphous Resin and Toner>

The glass transition temperatures Tg (° C.) of the amorphous resin and toner are measured in accordance with ASTM D3418-82 using a differential scanning calorimeter (Q1000, from TA Instruments). The melting points of indium and zinc are used for temperature calibration of the apparatus detector, and the heat of fusion of indium is used for calibrating the heat quantity.

Specifically, 2 mg of a measurement sample is weighed precisely, placed in an aluminum pan and, using an empty aluminum pan as a reference, the temperature is raised over a measurement range of 0° C. to 100° C. at a ramp rate of 10° C./min. The temperature is held at 100° C. for 15 minutes, after which cooling from 100° C. to 0° C. is carried out at a ramp-down rate of 10° C./min. The temperature is then held at 0° C. for 10 minutes, after which measurement is carried out at a ramp rate of 10° C./min from 0° C. to 100° C.

The glass transition temperature Tg (° C.) is taken to be the temperature at the point of intersection between a straight line that is equidistant in the vertical axis direction from straight-line extensions of the respective baselines before and after a change in specific heat arises on the specific heat difference curve in the course of this second temperature rise and the curve in the step-like change portion of the glass transition.

<Method of Measuring Charge Quantity>

Figure 2:
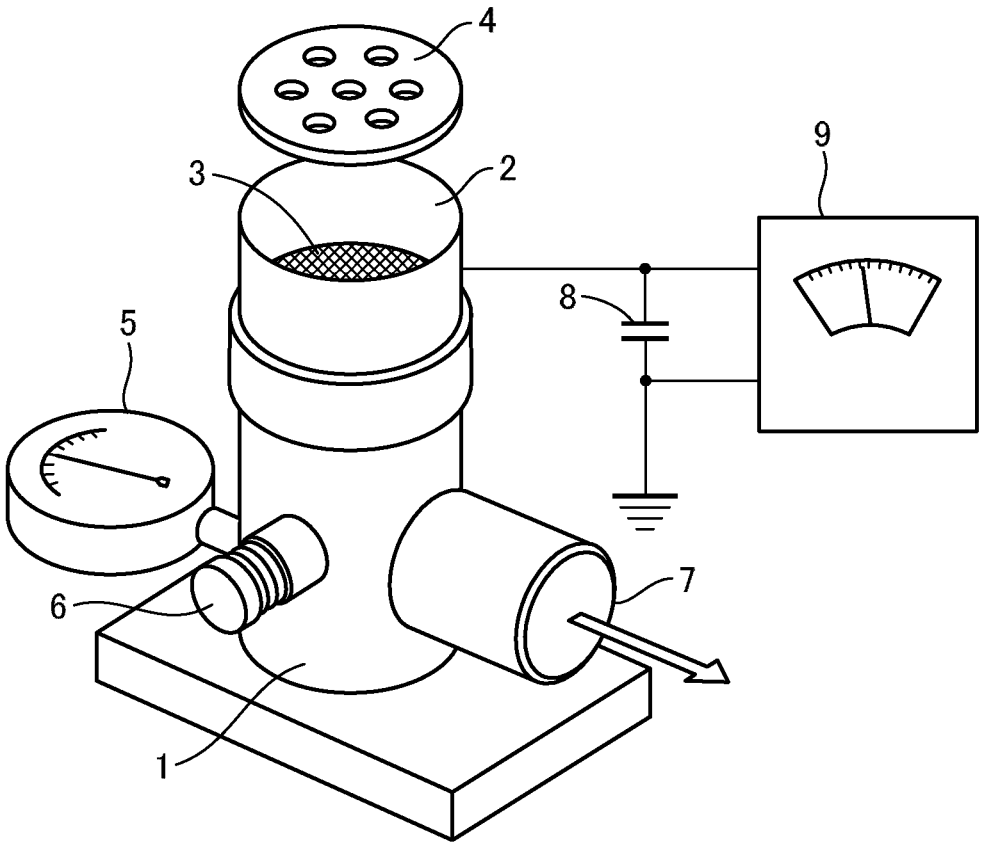
FIG. 2 is a schematic diagram of an apparatus used for measuring charge quantity in the invention.

In the apparatus (suction device 1) shown in FIG. 2, 0.1 g of the developer for which the charge quantity is to be measured is placed in a metal measuring vessel 2 having a 635-mesh screen 3 on the bottom, and a metal lid 4 is set on top. The mass of the entire measuring vessel 2 at this time is weighed and the result is designated as W1 (g). Next, in the suction device 1 (at least that portion of which is in contact with the measuring vessel 2 being an electrical insulator), suction is applied from a suction port 7, the pressure at a vacuum gauge 5 being set to 1.0 kPa by adjusting an air quantity control valve 6. Suction is carried out in this state for 1 minute, thereby aspirating and removing the toner. The potential on an electrometer 9 at this time is set in volts (V). Here, 8 is a capacitor, the capacitance of which is designated as C (mCF). The mass of the entire measuring vessel following aspiration is weighed and the result is designated as W2 (g). The charge quantity (mC/kg) of the toner is calculated as follows.

$$\text{Charge quantity(mC/kg)}=(C\times V)/(W1-W2)$$

<Method of Measuring Weight-Average Particle Diameter (D4) of Toner>

The weight-average particle diameter (D4) of the toner is calculated as follows. The measurement apparatus is a precision analyzer for particle size distribution based on the pore electrical resistance method and is equipped with a 100 μm aperture tube (COULTER COUNTER MULTISIZER 3®, manufactured by Beckman Coulter). Dedicated software (BECKMAN COULTER MULTISIZER 3, Version 3.51 (from Beckman Coulter)) furnished with the device is used for setting the measurement conditions and analyzing the measurement data. Measurement is carried out with the following number of effective measurement channels: 25,000.

The aqueous electrolyte solution used in measurement is one that has been obtained by dissolving guaranteed reagent grade sodium chloride in deionized water to a concentration of about 1 mass %. For example, use can be made of ISOTON II (from Beckman Coulter).

Prior to carrying out measurement and analysis, the following settings are carried out on the dedicated software. From the "Changing Standard Operating Mode (SOM)" screen of the software, select the Control Mode tab and set the Total Count to 50,000 particles, the Number of Runs to 1, and the Kd value to the value obtained using "Standard particle 10.0 μm" (Beckman Coulter). Pressing the "Threshold/Noise Level Measuring Button" automatically sets the threshold and noise levels. Set the Current to 1,600 μA, the Gain to 2 and the Electrolyte to ISOTON II, and place a check mark by "Flush aperture tube following measurement."

In the "Convert Pulse to Size Settings" screen of the software, set the Bin Spacing to "Log Diameter", the number of Size Bins to "256", and the particle size range to "from 2 μm to 60 μm".

The measurement method is as follows (1) Place 200 mL of the aqueous electrolyte solution in a 250 mL glass round-bottomed beaker for the Multisizer 3, set the beaker on the sample stand and carry out stirring counterclockwise with a stirrer rod at a speed of 24 rotations per second. Then use the "Aperture Flush" function in the software to remove debris and air bubbles from the aperture tube.

(2) Place 30 mL of the aqueous electrolyte solution in a 100 mL glass flat-bottomed beaker. Add thereto 0.3 mL of a dilution obtained by diluting the dispersant "Contaminon N" (a 10 mass % aqueous solution of a neutral (pH 7) cleanser for cleaning precision analyzers which is composed of a nonionic surfactant, an anionic surfactant and an organic builder; available from Wako Pure Chemical Industries, Ltd.) about 3-fold by mass with deionized water.

(3) Prepare for use a Tetora 150 ultrasonic dispersion system (Nikkaki Bios) having an electrical output of 120 W and equipped with two oscillators which oscillate at 50 kHz and are configured at a phase offset of 180 degrees. Place 3.3 L of deionized water in the water tank of the ultrasonic dispersion system and add about 2 mL of Contaminon N to the tank.

(4) Set the beaker prepared in (2) above in a beaker-securing hole of the ultrasonic dispersion system, and operate the system. Adjust the beaker height position so as to maximize the resonance state of the aqueous electrolyte solution liquid level within the beaker.

(5) Add 10 mg of toner a little at a time to the aqueous electrolyte solution within the beaker in (4) above while subjecting the solution to ultrasonic irradiation so as to effect dispersion. Then continue ultrasonic dispersion treatment for 60 seconds while suitably regulating operation so that the water temperature in the tank is at least 10° C. and not more than 40° C. during ultrasonic dispersion.

(6) Using a pipette, carry out dropwise addition of the aqueous electrolyte solution in (5) above having toner dispersed therein to the round-bottomed beaker in (1) above that has been set on the sample stand, and adjust the measurement concentration to 5%. Next, continue measurement until the number of measured particles reaches 50,000.

(7) Carry out analysis of the measurement data using the dedicated software provided with the Multisizer 3 system, and compute the weight-average particle diameter (D4). When "Graph/Vol %" is selected in the software program, the "average size" in the "Analysis/Volume Statistics (Cumulative Average)" pane is the weight-average particle diameter (D4).

Examples

The invention is described more fully below by way of examples, although these examples do not limit the invention. Unless noted otherwise, all references in the examples to parts and % are by mass. Toners 1 to 25 were produced as working examples of the invention, and Toners 26 to 38 were produced as comparative examples.

<Production of Amorphous Resin 1>

First, 100.0 parts of a mixture obtained by mixing together the starting monomers in the ratios (mol %) shown in Table 1 was added to a reaction vessel equipped with a stirrer, a thermometer, a nitrogen inlet, a drying tube and a pressure-reducing device, then heated to 130° C. under stirring. Next, 0.52 part of tin(II) 2-ethylhexanoate was added as an esterification catalyst, the temperature was raised to 200° C. and condensation polymerization was carried out to the desired molecular weight, giving Amorphous Resin 1. Amorphous Resin 1 had a weight-average molecular weight (Mw) of 12,000, a glass transition temperature (Tg) of 70° C., and an acid value of 6.7 mgKOH/g.

<Production of Amorphous Resins 2 to 18>

Amorphous Resins 2 to 18 were produced by carrying out the same operations as in the production of Amorphous Resin 1 using the starting monomers and their charging ratios shown in Table 1. The properties of the resulting Amorphous Resins 2 to 18 are shown in Table 1.

TABLE 1

| | Charging ratios (mol %) | | | | | | Properties | | |
|---|---|---|---|---|---|---|---|---|---|
| | Acid | | | Alcohol | | | | | |
| | TPA | TMA | Type and amount of alicyclic monomer | BPA-PO | EG | Type and amount of alicyclic monomer | Acid value (mgKOH/g) | Weight-average molecular weight (Mw) | Glass transition temperature (° C.) |
| Amorphous Resin1 | 38 | 2 | Cyclohexane dicarboxylic acid 10 | 35 | 15 | — | 6.7 | 12000 | 70 |
| Amorphous Resin2 | 38 | 2 | Cyclohexane dicarboxylic acid 10 | 30 | 20 | — | 6.9 | 12000 | 68 |
| Amorphous Resin3 | 38 | 2 | Cyclohexane dicarboxylic acid 10 | 20 | 30 | — | 7.0 | 12000 | 67 |
| Amorphous Resin4 | 46 | 3 | Cyclohexane dicarboxylic acid 1 | 35 | 15 | — | 6.4 | 14000 | 72 |
| Amorphous Resin5 | 38 | 2 | Cyclohexane dicarboxylic acid 10 | 40 | 10 | — | 6.9 | 12000 | 74 |
| Amorphous Resin6 | 43 | 2 | Cyclohexane dicarboxylic acid 5 | 35 | 15 | — | 6.4 | 14000 | 72 |
| Amorphous Resin7 | 18 | 2 | Cyclohexane dicarboxylic acid 30 | 35 | 15 | — | 6.7 | 12000 | 70 |
| Amorphous Resin8 | 0 | 0 | Cyclohexane dicarboxylic acid 50 | 35 | 15 | — | 7.0 | 11000 | 67 |
| Amorphous Resin9 | 0 | 0 | Cyclohexane dicarboxylic acid 50 | 25 | 15 | Cyclohexyl diol 10 | 7.6 | 11000 | 66 |
| Amorphous Resin10 | 46 | 4 | — | 25 | 15 | Isosorbide 10 | 5.4 | 10000 | 80 |
| Amorphous Resin11 | 46 | 4 | — | 25 | 15 | Cyclohexane dimethanol 10 | 6.7 | 12000 | 70 |
| Amorphous Resin12 | 46 | 4 | — | 25 | 15 | Cyclohexane diol 10 | 6.7 | 12000 | 70 |
| Amorphous Resin13 | 46 | 4 | — | 25 | 15 | Hydrogenated bisphenol A 10 | 6.7 | 12000 | 70 |

TABLE 1-continued

| | Charging ratios (mol %) | | | | | | Properties | | |
|---|---|---|---|---|---|---|---|---|---|
| | Acid | | | Alcohol | | | | Weight-average | Glass |
| | TPA | TMA | Type and amount of alicyclic monomer | BPA-PO | EG | Type and amount of alicyclic monomer | Acid value (mgKOH/g) | molecular weight (Mw) | transition temperature (° C.) |
| Amorphous Resin14 | 46 | 4 | — | 25 | 15 | Bicyclohexanol 10 | 6.7 | 12000 | 70 |
| Amorphous Resin15 | 46 | 4 | — | 20 | 30 | — | 6.8 | 10000 | 70 |
| Amorphous Resin16 | 38 | 2 | Cyclohexane dicarboxylic acid 10 | 15 | 35 | — | 7.2 | 10000 | 64 |
| Amorphous Resin17 | 46 | 4 | — | 15 | 15 | Isosorbide 20 | 4.8 | 8000 | 85 |
| Amorphous Resin18 | 46 | 4 | — | 50 | 0 | — | 8.2 | 15000 | 73 |
| Amorphous Resin19 | Styrene-acrylic resin | | | | | | 20.5 | 28000 | 85 |

In the table, TPA stands for terephthalic acid, TMA for trimellitic acid, BPA-PO for bisphenol A 2-mole propylene oxide adduct, and EG for ethylene glycol.

<Production of Amorphous Resin 19>

Xylene (200 parts) was added to a reaction vessel equipped with a stirrer, a condenser, a thermometer and a nitrogen inlet, and then refluxed under a stream of nitrogen.

| | |
|---|---|
| 2-Acrylamido-2-methylpropanesulfonic acid | 6.0 parts |
| Styrene | 72.0 parts |
| 2-Ethylhexyl acrylate | 18.0 parts |
| Dimethyl-2,2'-azobis(2-methylpropionate) | 5.0 parts |

The above monomers were mixed together and then added dropwise under stirring to the reaction vessel, where they were held at 65° C. for 10 hours. Next, distillation was carried out and the solvent driven off, followed by drying under reduced pressure at 40° C., giving Amorphous Resin 19. The properties of the resulting Amorphous Resin 19 are shown in Table 1.

<Production of Pigment-Adsorbing Segment 1 of Pigment Dispersant>

4-Nitroaniline (3.11 parts, from Tokyo Chemical Industry Co., Ltd.) was added to 30.00 parts of chloroform and the system was ice-cooled to 10° C. or below, then 1.89 parts of diketene (Tokyo Chemical Industry Co., Ltd.) was added. This was followed by 2 hours of stirring at 65° C. Following reaction completion, the reaction product was extracted with chloroform and then concentrated, giving Compound A.

Next, 40.00 parts of methanol and 5.29 parts of concentrated hydrochloric acid were added to 3.05 parts of 5-amino-2-benzimidazolinone (Tokyo Chemical Industry Co., Ltd.), and the system was ice-cooled to 10° C. or below. To this solution was added a solution of 2.10 parts of sodium nitrite dissolved in 6.00 parts of water, and the reaction was carried out at the same temperature for 1 hour.

Next, 0.99 part of sulfamic acid was added and another 20 minutes of stirring was carried out, giving a diazonium salt solution. The above Compound A, 4.51 parts, was added to 70.00 parts of methanol, the system was ice-cooled to 10° C. or below, and the diazonium salt solution was added thereto. A solution of 5.83 parts of sodium acetate dissolved in 7.00 parts of water was then added thereto and the reaction was carried out at 10° C. or below for 2 hours.

Following reaction completion, 300.00 parts of water was added and the system was stirred for 30 minutes, following which the solids were filtered off and purified by recrystallization from N,N-dimethylformamide, giving Compound B.

Next, 8.58 parts of Compound B and 0.40 part of palladium-activated carbon (palladium, 5%) were added to 150.00 parts of N,N-dimethylformamide, and the system was stirred at 40° C. for 3 hours under a hydrogen gas atmosphere (reaction pressure, 0.1 to 0.4 MPa). Following reaction completion, the solution was filtered off and concentrated, giving Pigment-Adsorbing Segment 1 of formula (6) below.

Formula (6)

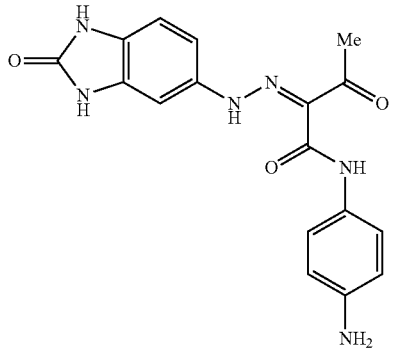

In this formula, Me represents a methyl group.

<Production of Pigment-Adsorbing Segment 2 of Pigment Dispersant>

The 3.05 parts of 5-amino-2-benzimidazolinone (Tokyo Chemical Industry Co., Ltd.) in the Pigment-Adsorbing Segment 1 production example was changed to 2.75 parts of 3-aminobenzamide (Tokyo Chemical Industry Co., Ltd.). Aside from this, Pigment-Adsorbing Segment 2 of formula (7) below was obtained in the same way as in the Pigment-Adsorbing Segment 1 production example.

Formula (7)

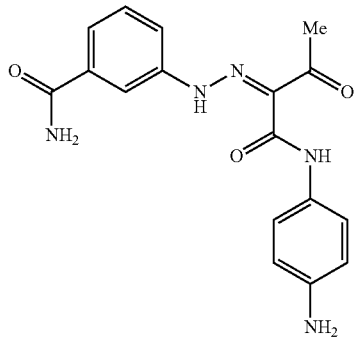

In this formula, Me represents a methyl group.

<Production of Styrene-Acrylic Resin 1 for Use in Pigment Dispersant>

Xylene (100 parts), 95 parts of styrene and 5 parts of acrylic acid were added to a reaction vessel and mixed together, and the temperature of the resulting mixture was raised to 70° C.

Under a nitrogen atmosphere, a solution of 3 parts of tert-butyl hydroperoxide (a radical polymerization initiator) dissolved in 10 parts of xylene was added dropwise to the mixture over about 30 minutes. The mixture was held at this temperature for another 10 hours, bringing the radical polymerization reaction to completion. In addition, the pressure was reduced while heating the mixture, removing 60 parts of the solvent xylene and thereby yielding a reaction solution.

Methanol (500 parts) was added to a vessel equipped with a stirring blade and the reaction solution was added dropwise over one hour under stirring. The resulting precipitate was filtered and washed, then dried, giving Styrene-Acrylic Resin 1.

<Production of Polyester Resin 1 for Use in Pigment Dispersant>

| | |
|---|---|
| Terephthalic acid | 50.0 parts |
| Isophthalic acid | 45.0 parts |
| Bisphenol A propylene oxide 2-mole adduct | 200.0 parts |

The above materials were charged into a 6-liter four-neck flask equipped with a nitrogen inlet, drying tube, stirrer and thermocouple and, with this reaction vessel under a nitrogen atmosphere, were reacted at 200° C. for 6 hours.

In addition, 3.0 parts of trimellitic anhydride was added at 210° C., the pressure was reduced to 5 kPa and the reaction was carried out. The reaction was continued until the weight-average molecular weight (Mw) reached 12,000. The resulting resin was Polyester Resin 1.

<Production of Pigment Dispersant 1>

Pigment-Adsorbing Segment 1 (1.5 parts) was added to 500.0 parts of tetrahydrofuran and dissolved by heating to 65° C. After dissolution, the temperature was lowered to 50° C., 15.0 parts of Styrene-Acrylic Resin 1 (styrene-acrylic resin segment) was dissolved, 2.0 parts of 1-ethyl-3-(3-dimethylaminopropyl)carbodiimide hydrochloride (EDC.HCl) was added, and the system was stirred for 5 hours at 50° C., following which 20.0 parts of methanol was added and the reaction was carried out at 65° C. for hour. The liquid temperature was cooling to room temperature, and the reaction was brought to completion by stirring overnight. Following reaction completion, the solution was filtered and concentrated, then purified by reprecipitation with methanol, giving Pigment Dispersant 1. In this pigment dispersant, the pigment-adsorbing segment had the structure represented by Formula (5) above and the divalent linker (L) was an amide group.

<Production of Pigment Dispersants 2 to 4>

Aside from changing the starting materials and amounts shown in Table 2, Pigment Dispersants 2 to 4 were obtained in the same way as the production method for Pigment Dispersant 1. Pigment Dispersant 2 had a pigment-adsorbing segment of the structure shown in Formula (4) above and the divalent linker (L) was an amide group. Pigment Dispersants 3 and 4 each had a pigment-adsorbing segment of the structure shown in Formula (5) above, and the divalent linker (L) was an amide group.

TABLE 2

| | Pigment-adsorbing segment | | Resin segment | |
|---|---|---|---|---|
| | Type | Amount charged (parts by mass) | Type | Amount charged (parts by mass) |
| Pigment Dispersant 1 | Pigment-Adsorbing Segment 1 | 1.5 | Styrene-Acrylic Resin 1 | 15.0 |
| Pigment Dispersant 2 | Pigment-Adsorbing Segment 2 | 1.5 | Styrene-Acrylic Resin 1 | 15.0 |
| Pigment Dispersant 3 | Pigment-Adsorbing Segment 1 | 1.5 | Polyester Resin 1 | 15.0 |
| Pigment Dispersant 4 | Pigment-Adsorbing Segment 1 | 0.3 | Styrene-Acrylic Resin 1 | 15.0 |

<Production of Toner 1>

Aqueous Medium Production Step:

Sodium phosphate (14 parts, from Rasa Industries, Ltd.) was added to 1,000 parts of deionized water in a reaction vessel, and warmed at 65° C. for 60 minutes under nitrogen purging.

Next, while stirring the above at 12,000 rpm in a TK Homomixer (a high-speed agitator available from Tokushu Kikai Kogyo), an aqueous solution of calcium chloride obtained by dissolving 7.8 parts of calcium chloride in 10 parts of deionized water was added all at once, thereby preparing a dispersion stabilizer-containing aqueous medium. In addition, the pH was adjusted to 5.8 by adding 4.5 parts of 10 mass % hydrochloric acid to this aqueous medium.

Polymerizable Monomer Composition Preparation Step:

| | |
|---|---|
| Styrene | 60.0 parts |
| Carbon black (CB) (NIPEX 35, from Degussa AG) | 8.0 parts |
| Pigment Dispersant 1 | 0.8 part |

A pigment dispersion was obtained by adding the above materials to an attritor-type disperser (Mitsui Miike Chemical Engineering Machinery) and dispersing at 220 rpm for 5 hours using 1.7 mm diameter zirconia particles, then removing the zirconia particles.

The following were added to the pigment dispersion:

| | |
|---|---|
| Styrene | 20.0 parts |
| n-Butyl acrylate (n-BA) | 20.0 parts |

-continued

| | |
|---|---|
| Amorphous Resin 1 | 5.0 parts |
| Paraffin wax (HNP-9, from Nippon Seiro Co., Ltd.; melting point, 75° C.), as a release agent | 7.0 parts |

These materials were held at a temperature of 65° C. and uniformly dissolved and dispersed at 500 rpm using a high-speed agitator (TK Homomixer), giving a polymerization monomer composition.

Granulating Step:

The polymerizable monomer composition was added to the aqueous medium while holding the temperature of the aqueous medium at 70° C. and maintaining the speed of the agitator at 15,000 rpm, and 9.0 parts of the polymerization initiator t-butyl peroxypivalate was added. Granulation was carried out in this manner for minutes with the agitator while maintaining the speed at 15,000 rpm.

Polymerization Step:

After replacing the high-speed agitator with a propeller-type agitating blade, a polymerization reaction was carried out by 5.0 hours of polymerization under stirring at 150 rpm while holding the temperature at 70° C., then raising the temperature to 85° C. and heating for another 2 hours, thereby giving a toner particle slurry.

Rinsing, Drying, Classification and External Addition Steps:

Following completion of the polymerization step, the slurry was cooled, the pH of the cooled slurry was adjusted to 1.4 by adding hydrochloric acid, and calcium phosphate was dissolved therein by one hour of stirring. Next, the slurry was rinsed with a 10-fold quantity of water, filtered and dried, following which the particle size was adjusted by classification, giving toner particles (toner particles prior to the addition of external additive).

Next, using a Henschel mixer (Mitsui Miike Chemical Engineering Machinery), 1.5 parts of a hydrophobic silica fine powder (primary particle size, 7 nm; BET specific surface area, 130 $m^2/g$) obtained by the hydrophobic treatment of silica fine powder with 20 mass % dimethyl silicone oil was mixed, as an external additive, for 15 minutes at a stirring speed of 3,000 rpm into 100.0 parts of the resulting toner particles, giving Toner 1.

<Production of Toners 2 to 23, 26 to 35 and 38>

Aside from changing the types and amounts of polymerizable monomers, the type and amount of pigment, the type and amount of pigment dispersant and the type and amount of amorphous resin as shown in Tables 3-1 and 3-2, Toners 2 to 23, 26 to 35 and 38 were obtained in the same way as in the production method for Toner 1. In all of these toners, the amount of styrene added when preparing the pigment dispersion was set to 60.0 parts, and the other polymerizable monomers were added following preparation of the pigment dispersion.

TABLE 3-1

| | | Production | Polymerizable monomer or binder resin | | Pigment | | Pigment dispersant | | Amorphous resin | | Toner properties | |
|---|---|---|---|---|---|---|---|---|---|---|---|---|
| Example | Toner | method | Type | Amount (parts) | Type | Amount (parts) | Type | Amount (parts) | Type | Amount (parts) | D | E |
| 1 | 1 | A | styrene/n-BA | 80.0/20.0 | CB | 8.0 | 1 | 0.8 | 1 | 5.0 | 33000 | 6.4 |
| 2 | 2 | A | styrene/n-BA | 80.0/20.0 | PR150 | 10.0 | 1 | 1.0 | 1 | 5.0 | 35000 | 7.1 |
| 3 | 3 | A | styrene/n-BA | 80.0/20.0 | PR122 | 10.0 | 1 | 1.0 | 1 | 5.0 | 35000 | 7.2 |
| 4 | 4 | A | styrene/n-BA | 80.0/20.0 | PY155/SY162 | 8.0/2.0 | 1 | 0.8 | 1 | 5.0 | 34000 | 7.4 |
| 5 | 5 | A | styrene/n-BA | 80.0/20.0 | CB | 8.0 | 2 | 0.8 | 1 | 5.0 | 33000 | 6.5 |
| 6 | 6 | A | styrene/n-BA | 80.0/20.0 | CB | 8.0 | 1 | 0.8 | 2 | 5.0 | 33000 | 6.3 |
| 7 | 7 | A | styrene/n-BA | 80.0/20.0 | CB | 8.0 | 1 | 0.8 | 3 | 5.0 | 33000 | 6.8 |
| 8 | 8 | A | styrene/n-BA/MAA | 80.0/20.0/2.0 | CB | 8.0 | 1 | 0.8 | 1 | 5.0 | 31000 | 5.9 |
| 9 | 9 | A | styrene/n-BA/MAA | 80.0/20.0/4.0 | CB | 8.0 | 1 | 0.8 | 1 | 5.0 | 30000 | 5.8 |
| 10 | 10 | A | styrene/n-BA | 80.0/20.0 | CB | 8.0 | 1 | 0.8 | 4 | 5.0 | 33000 | 6.5 |
| 11 | 11 | A | styrene/n-BA | 80.0/20.0 | PR150 | 10.0 | 1 | 1.0 | 5 | 5.0 | 34000 | 7.0 |
| 12 | 12 | A | styrene/n-BA | 80.0/20.0 | CB | 8.0 | 1 | 0.8 | 6 | 5.0 | 33000 | 6.5 |
| 13 | 13 | A | styrene/n-BA | 80.0/20.0 | CB | 8.0 | 1 | 0.8 | 7 | 5.0 | 33000 | 6.5 |
| 14 | 14 | A | styrene/n-BA | 80.0/20.0 | CB | 8.0 | 1 | 0.8 | 8 | 5.0 | 33000 | 8.9 |
| 15 | 15 | A | styrene/n-BA | 80.0/20.0 | CB | 8.0 | 1 | 0.8 | 9 | 5.0 | 33000 | 8.6 |
| 16 | 16 | A | styrene/n-BA | 80.0/20.0 | CB | 8.0 | 1 | 0.8 | 10 | 5.0 | 33000 | 5.5 |
| 17 | 17 | A | styrene/n-BA | 80.0/20.0 | CB | 8.0 | 1 | 0.8 | 11 | 5.0 | 33000 | 6.4 |
| 18 | 18 | A | styrene/n-BA | 80.0/20.0 | CB | 8.0 | 1 | 0.8 | 12 | 5.0 | 33000 | 6.4 |
| 19 | 19 | A | styrene/n-BA | 80.0/20.0 | CB | 8.0 | 1 | 0.8 | 13 | 5.0 | 33000 | 6.5 |
| 20 | 20 | A | styrene/n-BA | 80.0/20.0 | CB | 8.0 | 1 | 0.8 | 14 | 5.0 | 33000 | 6.5 |
| 21 | 21 | A | styrene/n-BA | 80.0/20.0 | CB | 8.0 | 1 | 0.8 | 19 | 5.0 | 33000 | 5.2 |
| 22 | 22 | A | styrene/n-BA | 80.0/20.0 | CB | 8.0 | 1 | 0.8 | 15 | 5.0 | 33000 | 6.6 |
| 23 | 23 | A | styrene/n-BA | 80.0/20.0 | CB | 8.0 | 3 | 0.8 | 1 | 5.0 | 33000 | 5.8 |
| 24 | 24 | B | Styrene-Acrylic Resin2 | 100.0 | CB | 8.0 | 1 | 0.8 | 1 | 5.0 | 22000 | 7.6 |
| 25 | 25 | C | Styrene-Acrylic Resin3 | 100.0 | CB | 8.0 | 1 | 0.8 | 1 | 5.0 | 20000 | 6.5 |

<Production method>

A: suspension polymerization

B: dissolution suspension

C: pulverization

<Toner properties>

D: Weight-average molecular weight (Mw)

E: Weight-average particle diameter (μm)

TABLE 3-2

| Comparative Example | Toner | Production method | Polymerizable monomer or binder resin Type | Amount (parts) | Pigment Type | Amount (parts) | Pigment dispersant Type | Amount (parts) | Amorphous resin Type | Amount (parts) | Toner properties D | E |
|---|---|---|---|---|---|---|---|---|---|---|---|---|
| 1 | 26 | A | styrene/n-BA | 80.0/20.0 | CB | 8.0 | 4 | 0.8 | 1 | 5.0 | 33000 | 6.6 |
| 2 | 27 | A | styrene/n-BA | 80.0/20.0 | CB | 8.0 | DA | 0.8 | 1 | 5.0 | 33000 | 7.5 |
| 3 | 28 | A | styrene/n-BA | 80.0/20.0 | CB | 8.0 | DA | 1.2 | 1 | 5.0 | 33000 | 7.5 |
| 4 | 29 | A | styrene/n-BA | 80.0/20.0 | CB | 8.0 | — | — | 1 | 5.0 | 33000 | 6.8 |
| 5 | 30 | A | styrene/n-BA | 80.0/20.0 | PR150 | 10.0 | — | — | 1 | 5.0 | 35000 | 7.4 |
| 6 | 31 | A | styrene/n-BA | 80.0/20.0 | PR122 | 10.0 | — | — | 1 | 5.0 | 35000 | 7.4 |
| 7 | 32 | A | styrene/n-BA | 80.0/20.0 | PY155/ SY162 | 8.0/ 2.0 | — | — | 1 | 5.0 | 34000 | 7.6 |
| 8 | 33 | A | styrene/n-BA | 80.0/20.0 | CB | 8.0 | 1 | 0.8 | 16 | 5.0 | 33000 | 6.4 |
| 9 | 34 | A | styrene/n-BA | 80.0/20.0 | CB | 8.0 | 1 | 0.8 | 17 | 5.0 | 33000 | 5.3 |
| 10 | 35 | A | styrene/n-BA | 80.0/20.0 | CB | 8.0 | 1 | 0.8 | 18 | 5.0 | 33000 | 6.5 |
| 11 | 36 | B | Polystyrene Resin 2 | 100.0 | CB | 8.0 | 1 | 0.8 | 1 | 5.0 | 12000 | 7.4 |
| 12 | 37 | B | Polystyrene Resin 2 | 100.0 | CB | 8.0 | 3 | 0.8 | 1 | 5.0 | 12000 | 7.2 |
| 13 | 38 | A | styrene/n-BA | 80.0/20.0 | CB | 8.0 | 2 | 0.8 | 18 | 5.0 | 33000 | 6.4 |

<Production method>
A: suspension polymerization
B: dissolution suspension
C: pulverization
<Toner properties>
D: Weight-average molecular weight (Mw)
E: Weight-average particle diameter (μm)

In Tables 3-1 and 3-2, n-BA stands for n-butyl acrylate, MAA for methacrylic acid, CB for carbon black, PR122 for C.I. Pigment Red 122, PR 150 for C.I. Pigment Red 150, PY155 for C.I. Pigment Yellow 155, SY162 for Solvent Yellow 162, and DA for Disparlon DA703-40, which is an amide and amine salt of polyester acid-type wetting and dispersing agent (Kusumoto Chemicals, Ltd.).

<Production of Toner 24>

The following materials were added, under a nitrogen atmosphere, to a reaction vessel equipped with a reflux condenser, stirrer and nitrogen inlet.

| | |
|---|---|
| Toluene | 100.0 parts |
| Styrene | 80.0 parts |
| n-Butyl acrylate | 20.0 parts |
| Methacrylic acid | 4.0 parts |
| t-Butyl peroxypivalate | 3.0 parts |

The mixture within this vessel was stirred at 200 rpm, heated to 70° C. and stirred for 10 hours. In addition, the mixture was heated to 100° C. and the solvent was distilled off for 6 hours, giving Styrene-Acrylic Resin 2.

Next, the following ingredients:

| | |
|---|---|
| Styrene-Acrylic Resin 2 | 100.0 parts |
| Carbon black (NIPEX35, from Degussa AG) | 8.0 parts |
| Pigment Dispersant 1 | 0.8 part |
| Amorphous Resin 1 | 5.0 parts |
| Paraffin wax (HNP-9, from Nippon Seiro Co., Ltd.; melting point, 75° C.), as a release agent | 7.0 parts |
| Ethyl acetate | 200.0 parts |

were mixed and dispersed for 10 hours in a ball mill, and the resulting dispersion was added to 2,000 parts of deionized water containing 3.5 mass % of tricalcium phosphate and granulation was carried out for 10 minutes with a high-speed agitator (TK Homomixer) at 15,000 rpm. The particles were then held in a water bath for 4 hours at 75° C. while being stirred at 150 rpm with a Three-One Motor, thereby carrying out solvent removal.

Next, as in the production example for Toner 1, rinsing, drying, classification and external addition steps were carried out, giving Toner 24.

<Production of Polyester Resin 2 for Toners 36 and 37>

| | |
|---|---|
| Terephthalic acid | 90.0 parts |
| Sebacic acid | 10.0 parts |
| Bisphenol A propylene oxide 2-mole adduct | 200.0 parts |

The above materials were added in the indicated proportions to a 6-liter, 4-neck flask equipped with a nitrogen inlet, a drying tube, a stirrer and a thermocouple, and these materials were reacted under a nitrogen atmosphere at 200° C. over a period of 6 hours.

In addition, 3.0 parts of trimellitic anhydride was added at 210° C., the pressure was reduced to 5 kPa, and the reaction was carried out and continued until the weight-average molecular weight (Mw) reached 12,000. The resulting resin was designated as Polyester Resin 2.

<Production of Toner 36>

Aside from changing Styrene-Acrylic Resin 2 to Polyester Resin 2, Toner 36 was obtained in the same way as in the production example for Toner 24.

<Production of Toner 37>

Aside from changing Styrene-Acrylic Resin 2 to Polyester Resin 2 and changing Pigment Dispersant 1 to Pigment Dispersant 3, Toner 37 was obtained in the same way as in the production example for Toner 24.

<Production of Toner 25>

The following materials were added, under a nitrogen atmosphere, to a reaction vessel equipped with a reflux condenser, stirrer and nitrogen inlet.

| | |
|---|---|
| Toluene | 100.0 parts |
| Styrene | 80.0 parts |
| n-Butyl acrylate | 20.0 parts |
| t-Butyl peroxypivalate | 3.0 parts |

The mixture within this vessel was stirred at 200 rpm, heated to 70° C. and stirred for 10 hours. In addition, the mixture was heated to 100° C. and the solvent was distilled off for 6 hours, then coarsely pulverized, giving Styrene-Acrylic Resin 3.

Next, the following ingredients:

| | |
|---|---|
| Styrene-Acrylic Resin 3 | 100 0 parts |
| Carbon black (NIPEX 35, from Degussa AG) | 8.0 parts |
| Pigment Dispersant 1 | 0.8 part |
| Amorphous Resin 1 | 5.0 parts |
| Paraffin wax (HNP-9, from Nippon Seiro Co., Ltd.; melting point, 75° C.), as a release agent | 7.0 parts |

were premixed in a Henschel mixer (FM-75, from Mitsui Miike Chemical Engineering Machinery), then melt-kneaded in a high rpm twin-screw extruder (PCM-30, from Ikegai Tekko KK) set to a temperature such that the temperature of the melt at the extruder outlet becomes 180° C. The kneaded material was cooled and then coarsely pulverized to a size of 1 mm or less with a hammer mill, giving a coarsely pulverized material. The coarsely pulverized material was then finely ground using a Turbo Mill T250 (Turbo Kogyo Co., Ltd.) as the grinding mill. The resulting finely ground powder was classified using a multi-grade classifier that employs the Coanda effect. Next, an external addition step was carried out in the same way as in the Toner 1 production example, thereby giving Toner 25.

The physical properties of the toners obtained above are collectively shown in Tables 3-1 and 3-2.

<Production of Binder Resins 1 to 23, 26 to 35 and 38>

Polymerizable monomer alone was polymerized under the same production conditions as in the respective production examples for Toners 1 to 23, 26 to 35 and 38 produced by suspension polymerization, thereby giving the Binder Resins 1 to 23, 26 to 35 and 38 in the respective toners.

The adsorption rate A1, adsorption rate A2, Rf value RFL and Rf value RfH for the pigments, pigment dispersants, amorphous resins and binder resins used in the respective toners were measured by the methods described above. The results are collectively shown in Table 4.

TABLE 4

| | Composition | | | | | Adsorption rate | | Rf value | |
|---|---|---|---|---|---|---|---|---|---|
| | Toner | | Pigment Dispersant | Amorphous Resin | Binder Resin | A1 | A2 | | |
| | No. | Pigment | No. | No. | No. | % | % | RfL | RfH |
| Example 1 | 1 | CB | 1 | 1 | 1 | 95 | 40 | 0.90 | 0.25 |
| Example 2 | 2 | PR150 | 1 | 1 | 2 | 90 | 25 | 0.90 | 0.25 |
| Example 3 | 3 | PR122 | 1 | 1 | 3 | 98 | 40 | 0.90 | 0.25 |
| Example 4 | 4 | PY155/ SY162 | 1 | 1 | 4 | 85 | 40 | 0.90 | 0.25 |
| Example 5 | 5 | CB | 2 | 1 | 5 | 80 | 40 | 0.90 | 0.25 |
| Example 6 | 6 | CB | 1 | 2 | 6 | 95 | 55 | 0.90 | 0.15 |
| Example 7 | 7 | CB | 1 | 3 | 7 | 95 | 60 | 0.90 | 0.10 |
| Example 8 | 8 | CB | 1 | 1 | 8 | 95 | 40 | 0.75 | 0.25 |
| Example 9 | 9 | CB | 1 | 1 | 9 | 95 | 40 | 0.55 | 0.25 |
| Example 10 | 10 | CB | 1 | 4 | 10 | 95 | 40 | 0.90 | 0.35 |
| Example 11 | 11 | PR150 | 1 | 5 | 11 | 90 | 20 | 0.90 | 0.35 |
| Example 12 | 12 | CB | 1 | 6 | 12 | 95 | 40 | 0.90 | 0.30 |
| Example 13 | 13 | CB | 1 | 7 | 13 | 95 | 45 | 0.90 | 0.15 |
| Example 14 | 14 | CB | 1 | 8 | 14 | 95 | 50 | 0.90 | 0.10 |
| Example 15 | 15 | CB | 1 | 9 | 15 | 95 | 60 | 0.90 | 0.05 |
| Example 16 | 16 | CB | 1 | 10 | 16 | 95 | 60 | 0.90 | 0.05 |
| Example 17 | 17 | CB | 1 | 11 | 17 | 95 | 40 | 0.90 | 0.15 |
| Example 18 | 18 | CB | 1 | 12 | 18 | 95 | 35 | 0.90 | 0.20 |
| Example 19 | 19 | CB | 1 | 13 | 19 | 95 | 40 | 0.90 | 0.30 |
| Example 20 | 20 | CB | 1 | 14 | 20 | 95 | 40 | 0.90 | 0.25 |
| Example 21 | 21 | CB | 1 | 19 | 21 | 95 | 60 | 0.90 | 0.35 |
| Example 22 | 22 | CB | 1 | 15 | 22 | 95 | 60 | 0.90 | 0.30 |
| Example 23 | 23 | CB | 3 | 1 | 23 | 80 | 40 | 0.90 | 0.25 |
| Example 24 | 24 | CB | 1 | 1 | Styrene-Acrylic Resin 2 | 95 | 40 | 0.55 | 0.25 |
| Example 25 | 25 | CB | 1 | 1 | Styrene-Acrylic Resin 3 | 95 | 40 | 0.90 | 0.25 |
| Comparative Example 1 | 26 | CB | 4 | 1 | 26 | 75 | 40 | 0.90 | 0.25 |
| Comparative Example 2 | 27 | CB | DA | 1 | 27 | 60 | 40 | 0.90 | 0.25 |
| Comparative Example 3 | 28 | CB | DA | 1 | 28 | 60 | 40 | 0.90 | 0.25 |
| Comparative Example 4 | 29 | CB | — | 1 | 29 | — | 40 | 0.90 | 0.25 |
| Comparative Example 5 | 30 | PR150 | — | 1 | 30 | — | 25 | 0.90 | 0.25 |
| Comparative Example 6 | 31 | PR122 | — | 1 | 31 | — | 40 | 0.90 | 0.25 |
| Comparative Example 7 | 32 | PY155/ SY162 | — | 1 | 32 | — | 40 | 0.90 | 0.25 |
| Comparative Example 8 | 33 | CB | 1 | 16 | 33 | 95 | 65 | 0.90 | 0.05 |

TABLE 4-continued

| | Toner | Composition | | | | Adsorption rate | | Rf value | |
|---|---|---|---|---|---|---|---|---|---|
| | | | Pigment | Amorphous | Binder | | | | |
| | | | Dispersant | Resin | Resin | A1 | A2 | | |
| | No. | Pigment | No. | No. | No. | % | % | RfL | RfH |
| Comparative Example 9 | 34 | CB | 1 | 17 | 34 | 95 | 65 | 0.90 | 0.05 |
| Comparative Example 10 | 35 | CB | 1 | 18 | 35 | 95 | 30 | 0.90 | 0.50 |
| Comparative Example 11 | 36 | CB | 1 | 1 | Polyester Resin 2 | 95 | 40 | 0.45 | 0.25 |
| Comparative Example 12 | 37 | CB | 3 | 1 | Polyester Resin 2 | 80 | 40 | 0.45 | 0.25 |
| Comparative Example 13 | 38 | CB | 2 | 18 | 38 | 80 | 30 | 0.90 | 0.50 |

The following methods were used to conduct performance evaluations on each of the toners obtained.

<Tinting Strength>

The toner contained in a toner cartridge for a commercial color laser printer (Satera LBP7700C, from Canon, Inc.) was removed, following which the interior of the cartridge was cleaned out with an air blower and then packed with 150 g of the toner to be evaluated.

In addition, a color laser printer (Satera LBP7700C, from Canon, Inc.) was partially modified by removing the fixing unit and altering the printer so that it can output unfixed images, and making it possible to adjust the image density with a controller. The printer was also modified so as to operate even when only loaded with a monochrome process cartridge. The removed fixing unit was modified so as to be operable alone, and was also modified into an external fixing unit whose process speed and temperature can be controlled.

Figure 3:
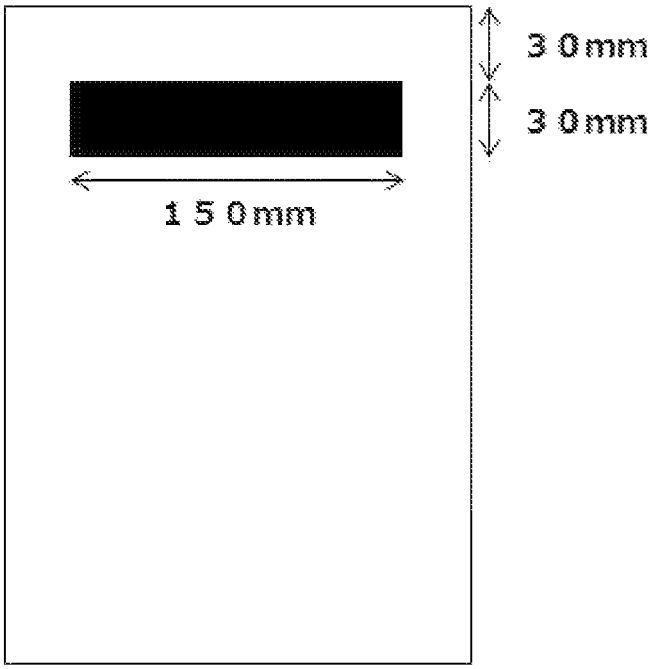
FIG. 3 is a schematic diagram showing the image pattern used to evaluate tinting strength in the invention.

The above cartridge was loaded into the printer and, as shown in FIG. 3, a 150 mm wide by 30 mm high band image was created after a 30 mm blank region at the top of a sheet of transfer material.

The controller was set so that the toner laid-on level in the band image becomes 0.35 mg/cm$^2$. The transfer material used was A4 size GF-0081 paper (Canon, Ltd.; 81.4 g/m$^2$).

Ten prints of this band image were output. And, using the LBP7700C external fixing unit, the ten prints of the band image were fixed with the process speed of 300 mm/sec and temperature of 160° C. The image density of this band image was measured and the tinting strength was evaluated. Measurement of the image density was carried out with a Macbeth RD918 reflection densitometer (from Macbeth). The image density was evaluated by measuring the relative density with respect to an output image of a white-ground region having a density of 0.00. Three points (left side, center and right side of band image) on each print of the output image were measured, and the average value for ten prints was determined. The evaluation criteria were as follows. The results are shown in Table 5.

(Evaluation Criteria)

A: Image density was at least 1.40 (tinting strength was excellent)

B: Image density was at least 1.30 and less than 1.40 (tinting strength was good)

C: Image density was at least 1.20 and less than 1.30

D: Image density was at least 1.10 and less than 1.20 (tinting strength was somewhat poor)

E: Image density was less than 1.10 (tinting strength was poor)

<Durability>

Evaluation of the durability was carried out after modifying a commercial color laser printer (HP Color LaserJet 3525dn, from Hewlett-Packard Company) so as to operate even when loaded with only a monochrome process cartridge. The toner contained in the cartridge that had been loaded into the color laser printer was removed and the interior of the cartridge was cleaned out with an air blower and packed instead with 200 g of the toner to be evaluated. Using "Office Planner" from Canon Inc. (64 g/m$^2$) as the receiver paper, a chart having a print percentage of 1% was continuously printed out in a print run of 50,000 pages at normal temperature and humidity (23° C., 60% RH). Following this print run, halftone images were also output, the development roller and the halftone images were examined for the presence or absence of vertical streaks in the paper discharge direction that could be regarded as development streaks, and the durability was evaluated based on the criteria shown below. Because toner of excellent durability is not prone to collapse and breakage of the toner particles and thus does not tend to adhere to the development roller, streaks do not readily arise. The results are shown in Table 5.

(Evaluation Criteria)

A: Vertical streaks in paper discharge direction are not visible on development roller or halftone images (excellent durability).

B: From 1 to 3 fine streaks are present on development roller, but vertical streaks in paper discharge direction are not visible on halftone images (good durability).

C: From 4 to 6 fine streaks are present on development roller, but vertical streaks in paper discharge direction are not visible on halftone images.

D: From 7 to 9 fine streaks are present on development roller, and vertical streaks in paper discharge direction are visible on halftone images (somewhat poor durability).

E: Ten or more distinct vertical streaks in paper discharge direction are visible on development roller and halftone images (poor durability).

<Charging Performance>

The fogging density was determined in order to evaluate the charging performance. After the print run of 50,000 pages in the durability test, the printer was left to stand for one week, following which one page of an image having a white-ground region was output onto Office Planner paper (Canon Inc.; 64 g/m$^2$) as the receiver paper. The difference between the degree of whiteness of the white-ground region (reflectance Ds (%)) on the image having a white-ground region and the degree of whiteness of the receiver paper (average reflectance Dr (%)) was used to calculate the fogging density (%), defined here as Dr (%)−Ds (%). The whiteness was measured using a TC-6DS reflectometer model from Tokyo Denshoku Co., Ltd. An amber light filter was used. Evaluation of the charging performance was carried out based on the following criteria. The results are shown in Table 5.

(Evaluation Criteria)

A: Fogging density is less than 0.3% (excellent charging performance)

B: Fogging density is at least 0.3% and less than 0.8% (good charging performance)

C: Fogging density is at least 0.8% and less than 1.3%

D: Fogging density is at least 1.3% and less than 2.0% (somewhat poor charging performance)

E: Fogging density is at least 2.0% (poor charging performance)

<Environmental Stability of Charging Performance>

Two-component developers were prepared as follows in order to evaluate the environmental stability of the charging performance.

Two-component developers of each toner were prepared by adding 279 g of the magnetic carrier F813-300 (Powdertech) and 21 g of the toner to be evaluated to a 500 mL plastic bottle having a lid, and shaking the bottle for 1 minute at a speed of 4 cycles per second on a YS-LD shaker (Yayoi Co., Ltd.).

Next, 10 g of the two-component developer was placed in a 50 mL plastic container and left one full day in a normal-temperature, normal-humidity environment (23° C., 60% RH). The container was then shaken 450 times over 3 minutes. Next, the triboelectric charge quantity was measured by the above-described technique, and the resulting charge quantity was designated as N (mC/kg).

In addition, 10 g of the two-component developer was placed in a 50 mL plastic container and left one full day in a high-temperature, high-humidity environment (30° C., 80% RH). The container was then shaken 450 times over 3 minutes, and the resulting charge quantity measured by the same method as above was designated as H (mC/kg).

These charge quantities N and H were used as follows to calculate the charge retention (%) in a high-temperature environment.

$$\text{Charge retention (\%)} = 100 \times \text{charge quantity } H(\text{mC/kg}) / \text{charge quantity } N(\text{mC/kg})$$

The environmental stability of the charge performance was evaluated based on the following criteria. The results are shown in Table 5.

(Evaluation Criteria)

A: Charge retention is at least 70% (environmental stability of charge performance is excellent)

B: Charge retention is at least 60% and less than 70% (environmental stability of charge performance is good)

C: Charge retention is at least 50% and less than 60%

D: Charge retention is at least 40% and less than 50% (environmental stability of charge performance is somewhat poor)

E: Charge retention is less than 40% (environmental stability of charge performance is poor)

TABLE 5

| | | Tinting strength | | Durability | | Charge performance | | Environmental stability | |
|---|---|---|---|---|---|---|---|---|---|
| | | Image density | Rating | Number of streaks | Rating | Fogging density (%) | Rating | Charge retention (%) | Rating |
| Example 1 | Toner 1 | 1.48 | A | 0 | A | 0.0 | A | 75 | A |
| Example 2 | Toner 2 | 1.48 | A | 0 | A | 0.0 | A | 77 | A |
| Example 3 | Toner 3 | 1.42 | A | 0 | A | 0.0 | A | 77 | A |
| Example 4 | Toner 4 | 1.38 | B | 0 | A | 0.1 | A | 75 | A |
| Example 5 | Toner 5 | 1.35 | B | 0 | A | 0.0 | A | 71 | A |
| Example 6 | Toner 6 | 1.39 | B | 1 | B | 0.7 | B | 62 | B |
| Example 7 | Toner 7 | 1.29 | C | 3 | B | 1.1 | C | 55 | C |
| Example 8 | Toner 8 | 1.45 | A | 3 | B | 0.1 | A | 67 | B |
| Example 9 | Toner 9 | 1.43 | A | 6 | C | 0.3 | B | 63 | B |
| Example 10 | Toner 10 | 1.48 | A | 4 | C | 0.3 | B | 67 | B |
| Example 11 | Toner 11 | 1.49 | A | 0 | A | 0.0 | A | 77 | A |
| Example 12 | Toner 12 | 1.48 | A | 3 | B | 0.5 | B | 70 | A |
| Example 13 | Toner 13 | 1.45 | A | 0 | A | 0.1 | A | 77 | A |
| Example 14 | Toner 14 | 1.32 | B | 0 | A | 0.1 | A | 83 | A |
| Example 15 | Toner 15 | 1.28 | C | 3 | B | 0.9 | C | 75 | A |
| Example 16 | Toner 16 | 1.25 | C | 4 | C | 0.8 | C | 57 | C |
| Example 17 | Toner 17 | 1.48 | A | 0 | A | 0.0 | A | 75 | A |
| Example 18 | Toner 18 | 1.51 | A | 0 | A | 0.2 | A | 75 | A |
| Example 19 | Toner 19 | 1.47 | A | 1 | B | 0.3 | B | 70 | A |
| Example 20 | Toner 20 | 1.47 | A | 0 | A | 0.1 | A | 73 | A |
| Example 21 | Toner 21 | 1.29 | C | 3 | B | 0.3 | B | 53 | C |
| Example 22 | Toner 22 | 1.28 | C | 4 | C | 1.2 | C | 56 | C |
| Example 23 | Toner 23 | 1.22 | C | 0 | A | 0.1 | A | 72 | A |
| Example 24 | Toner 24 | 1.44 | A | 6 | C | 0.5 | B | 67 | B |
| Example 25 | Toner 25 | 1.46 | A | 6 | C | 1.2 | C | 71 | A |
| Comparative Example 1 | Toner 26 | 1.18 | D | 0 | A | 0.2 | A | 75 | A |
| Comparative Example 2 | Toner 27 | 1.05 | E | 3 | B | 1.6 | D | 43 | D |
| Comparative Example 3 | Toner 28 | 1.09 | E | 6 | C | 2.5 | E | 32 | E |
| Comparative Example 4 | Toner 29 | 1.00 | E | 5 | C | 0.1 | A | 77 | A |
| Comparative Example 5 | Toner 30 | 0.98 | E | 4 | C | 0.1 | A | 71 | A |

TABLE 5-continued

| | | Tinting strength | | Durability: Number of streaks | | Charge performance | | Environmental stability | |
|---|---|---|---|---|---|---|---|---|---|
| | | Image density | Rating | | Rating | Fogging density (%) | Rating | Charge retention (%) | Rating |
| Comparative Example 6 | Toner 31 | 0.94 | E | 5 | C | 0.0 | A | 71 | A |
| Comparative Example 7 | Toner 32 | 1.08 | E | 5 | C | 0.1 | A | 75 | A |
| Comparative Example 8 | Toner 33 | 1.19 | D | 3 | B | 2.2 | E | 48 | D |
| Comparative Example 9 | Toner 34 | 1.15 | D | 3 | B | 2.2 | E | 50 | C |
| Comparative Example 10 | Toner 35 | 1.50 | A | 8 | D | 0.9 | C | 83 | A |
| Comparative Example 11 | Toner 36 | 1.35 | B | 10 | E | 1.1 | C | 56 | C |
| Comparative Example 12 | Toner 37 | 1.28 | C | 12 | E | 1.2 | C | 50 | C |
| Comparative Example 13 | Toner 38 | 1.35 | B | 7 | D | 0.8 | C | 68 | B |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-034758, filed Feb. 25, 2015, Japanese Patent Application No. 2016-7281, filed Jan. 18, 2016 which are hereby incorporated by reference herein in their entirety.

What is claimed is:

1. A toner comprising a toner particle comprising:

a binder resin;

a pigment;

a pigment dispersant; and an amorphous polyester resin having a unit derived from a non-cyclic aliphatic diol, wherein the pigment dispersant has a rate of adsorption A1 (%) to the pigment of 80 to 100% as measured for a mixture obtained by mixing together 0.1 part by mass of the pigment dispersant, 1.0 part by mass of the pigment and 20 parts by mass of a solvent in which styrene and n-butyl acrylate are mixed in a 4:1 ratio by mass, the amorphous resin has a rate of adsorption A2 (%) to the pigment of 0 to 60% as measured for a mixture obtained by mixing together 0.1 part by mass of the amorphous resin, 1.0 part by mass of the pigment and 20 parts by mass of a solvent in which styrene and n-butyl acrylate are mixed in a 4:1 ratio by mass, the binder resin has an Rf value (RfL) of 0.50 to 1.00 as measured by thin-layer chromatography at 60° C. using a solution of the binder resin, silica gel as a stationary phase and a developing solvent, the solution of the binder resin being obtained by mixing together 0.1 part by mass of the binder resin and 20 parts by mass of a solvent in which styrene and n-butyl acrylate are mixed in a 4:1 ratio by mass, and the developing solvent being obtained by mixing together styrene and n-butyl acrylate in a 1:1 ratio by mass, and the amorphous resin has an Rf value (RfH) of 0.00 to 0.35 as measured by thin-layer chromatography at 60° C. using a solution of the amorphous resin, silica gel as a stationary phase and the developing solvent, the solution of the amorphous resin being obtained by mixing together 0.1 part by mass of the amorphous resin and 20 parts by mass of a solvent in which styrene and n-butyl acrylate are mixed in a 4:1 ratio by mass.

2. The toner according to claim 1, wherein the polyester resin has an unit derived from an alcohol having an alicyclic structure or an unit derived from a carboxylic acid having an alicyclic structure on either a main chain or a side chain.

3. The toner according to claim 2, wherein a content ratio of the unit derived from the alcohol having an alicyclic structure or the unit derived from the carboxylic acid having an alicyclic structure, based on all monomer units of the polyester resin, is 0.1 to 50 mol %.

4. The toner according to claim 1, wherein the pigment dispersant has a pigment-adsorbing segment and a styrene-acrylic resin segment.

5. The toner according to claim 4, wherein the pigment-adsorbing segment has a structure represented by formula (1)

(1)

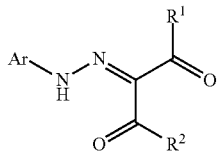

wherein $R^1$ and $R^2$ are each independently a substituted or unsubstituted alkyl group, a substituted or unsubstituted phenyl group, —$OR^5$ or —$NR^6R^7$, $R^5$, $R^6$ and $R^7$ are each independently a hydrogen atom, a substituted or unsubstituted alkyl group, a substituted or unsubstituted phenyl group or an aralkyl group, Ar is a substituted or unsubstituted aryl group, at least one of $R^1$, $R^2$ and Ar is a substituent having a linking group that bonds with the styrene-acrylic resin segment, the substituent having the same meaning as the groups represented by $R^1$, $R^2$ and Ar, with the proviso that the linking group is a divalent linking group selected from the group consisting of —C(═O)—NH—, —C(═O)—O—, —NH—C(═O)—O—, —NH—C(═O)—NH—, an alkylene group, a phenylene group, —O—, —$NR^g$— and —NHCH($CH_2$OH)— when at least one of $R^1$ and Ar is a substituent having a linking group that bonds with the styrene-acrylic resin segment, and the linking group is a divalent linking group selected from the group consisting of —C(=O)—NH—, —C(=O)—O—, —NH—C(=O)—O—, —NH—C(=O)—NH—, an alkylene group, a phenylene group, —O—, —$NR^9$— and —NHCH($CH_2$OH)— when $R^2$ is a substituent having a linking group that bonds with the styrene-acrylic resin segment, $R^8$ is a hydrogen atom, an alkyl group, a phenyl group or an aralkyl group, and $R^9$ is a hydrogen atom, an alkyl group, a phenyl group or an aralkyl group.

6. The toner according to claim 1, wherein A2 is 0 to 50%.

7. The toner according to claim 1, wherein the amorphous resin has a weight-average molecular weight (Mw) of 11,000 to 40,000.

8. A method of producing a toner comprising a toner particle comprising:

a binder resin;

a pigment;

a pigment dispersant; and an amorphous polyester resin having a unit derived from a non-cyclic aliphatic diol, wherein the pigment dispersant has a rate of adsorption A1 (%) to the pigment of 80 to 100% as measured for a mixture obtained by mixing together 0.1 part by mass of the pigment dispersant, 1.0 part by mass of the pigment and 20 parts by mass of a solvent in which styrene and n-butyl acrylate are mixed in a 4:1 ratio by mass, the amorphous resin has a rate of adsorption A2 (%) to the pigment of 0 to 60% as measured for a mixture obtained by mixing together 0.1 part by mass of the amorphous resin, 1.0 part by mass of the pigment and 20 parts by mass of a solvent in which styrene and n-butyl acrylate are mixed in a 4:1 ratio by mass, the binder resin has an Rf value (RfL) of 0.50 to 1.00 as measured by thin-layer chromatography at 60° C. using a solution of the binder resin, silica gel as a stationary phase and a developing solvent, the solution of the binder resin being obtained by mixing together 0.1 part by mass of the binder resin and 20 parts by mass of a solvent in which styrene and n-butyl acrylate are mixed in a 4:1 ratio by mass, and the developing solvent being obtained by mixing together styrene and n-butyl acrylate in a 1:1 ratio by mass, and the amorphous resin has an Rf value (RfH) of 0.00 to 0.35 as measured by thin-layer chromatography at 60° C. using a solution of the amorphous resin, silica gel as a stationary phase and the developing solvent, the solution of the amorphous resin being obtained by mixing together 0.1 part by mass of the amorphous resin and 20 parts by mass of a solvent in which styrene and n-butyl acrylate are mixed in a 4:1 ratio by mass, the method comprising the step of producing the toner particle including step (1) or (2) below:

(1) a step including a granulating step of forming, in an aqueous medium, a particle of a polymerizable monomer composition containing a polymerizable monomer capable of forming the binder resin, the pigment, the pigment dispersant and the amorphous resin; and a polymerization step of polymerizing the polymerizable monomer included in the particle of the polymerizable monomer composition, (2) a step including a dissolution step of dissolving or dispersing the binder resin, the pigment, the pigment dispersant and the amorphous resin in an organic solvent to prepare a resin solution; a granulating step of forming a particle of the resin solution in an aqueous medium; and a solvent removal step of removing the organic solvent included in the particle of the resin solution to produce a resin particle.

9. The toner according to claim 1, wherein the content ratio of the units derived from the non-cyclic aliphatic diol is 10 to 30 mol % based on all the monomer units of the polyester resin.

* * * * *